US012150511B2

(12) United States Patent
Baker et al.

(10) Patent No.: US 12,150,511 B2
(45) Date of Patent: Nov. 26, 2024

(54) HELMET WITH A REVERSIBLE VISOR

(71) Applicant: Kids ProLids IP, LLC, Tulsa, OK (US)

(72) Inventors: Brett G. Baker, Tulsa, OK (US); Michael Velasquez, Jr., Tulsa, OK (US); Hilgard N. Muller, Willows, CA (US)

(73) Assignee: Kids ProLids IP, LLC, Tulsa, OK (US)

( * ) Notice: Subject to any disclaimer, the term of this patent is extended or adjusted under 35 U.S.C. 154(b) by 104 days.

(21) Appl. No.: 17/536,283

(22) Filed: Nov. 29, 2021

(65) Prior Publication Data

US 2023/0165335 A1 Jun. 1, 2023

(51) Int. Cl.
*A42B 3/22* (2006.01)
*A42B 3/06* (2006.01)

(52) U.S. Cl.
CPC ..... *A42B 3/221* (2013.01); *A42B 3/06* (2013.01)

(58) Field of Classification Search
CPC .. A42B 3/221; A42B 3/06; A42B 3/22; A42B 1/205; A42B 3/0406; A42B 1/08; A42B 1/069; A42B 1/067; A42B 1/064
USPC ..... 2/10, 209.12, 195.1, 195.7
See application file for complete search history.

(56) References Cited

U.S. PATENT DOCUMENTS 2,855,604 A * 10/1958 Austin ..... A42B 3/227 2/171.1
5,437,062 A * 8/1995 Douglas ..... A42B 1/0184 2/209.12
5,471,684 A * 12/1995 Casale ..... A42B 1/0184 2/10
5,481,759 A * 1/1996 Rinaldi ..... A42B 1/0181 2/171.1
5,519,895 A * 5/1996 Barnes, Jr. ..... A42B 1/08 2/425
5,675,843 A 10/1997 Grim et al.
5,862,523 A * 1/1999 Proctor ..... A42B 1/247 2/209.11
6,170,084 B1 1/2001 Gordon et al.
6,539,556 B1 * 4/2003 Barker ..... A42B 1/0182 2/425

(Continued)

FOREIGN PATENT DOCUMENTS

FR 2719749 A1 11/1995
KR 20150112663 A 10/2015

OTHER PUBLICATIONS

Search Report and Written Opinion; ISA/KR; PCT/US2022/079838; Mar. 21, 2023.

*Primary Examiner* — Jameson D Collier
(74) *Attorney, Agent, or Firm* — Crowe & Dunlevy, P.C.

(57) ABSTRACT

The invention relates to an improved helmet with an outer protective shell having a forward-facing portion and a rearward-facing portion and an inner absorbent shell having a forward-facing portion and a rearward-facing portion. The helmet also has a visor that is removably attachable to the forward-facing portion and the rearward-facing portion of the outer protective shell, the inner absorbent shell, or a combination of both the outer protective shell and the inner absorbent shell, such that it can quickly and easily attach and detach from the forward-facing position on the front portion of the helmet to the backward-facing position on the rear portion of the helmet.

15 Claims, 42 Drawing Sheets

(56) References Cited

U.S. PATENT DOCUMENTS

| | | | | |
|---|---|---|---|---|
| 9,591,885 | B2 | 3/2017 | Cheng | |
| 10,743,603 | B2 | 8/2020 | McDavitt | |
| 2007/0017003 | A1* | 1/2007 | Harris | A42B 1/0184 2/195.1 |
| 2011/0307997 | A1* | 12/2011 | Blair | A42B 3/128 2/414 |
| 2014/0143937 | A1 | 5/2014 | Bell | |
| 2015/0189938 | A1* | 7/2015 | Reinhart | A42B 1/0184 2/195.2 |
| 2017/0035134 | A1* | 2/2017 | Olivera, II | A42B 1/0184 |
| 2017/0347736 | A1 | 12/2017 | Penner et al. | |
| 2018/0000180 | A1* | 1/2018 | Gholson | A42B 1/205 |
| 2018/0092427 | A1* | 4/2018 | Jacobsen | A42B 3/221 |
| 2018/0146734 | A1* | 5/2018 | Kelly | A42B 1/004 |
| 2018/0303190 | A1 | 10/2018 | Oakley | |
| 2019/0297981 | A1 | 10/2019 | Son | |
| 2021/0093034 | A1 | 4/2021 | Bell | |

* cited by examiner

HELMET WITH A REVERSIBLE VISOR

BACKGROUND OF THE INVENTION

1. Field of the Invention

This invention relates generally to a helmet with a reversible visor, and more particularly to a helmet with a visor that removably couples to the helmet at a front portion in a forward-facing configuration or at a rear portion in a backward-facing configuration.

2. Description of the Related Art

Sports such as bicycling, in-line skating, and skateboarding require protective helmets. The helmet is a protective shell that is designed to protect the head. Helmets generally include a visor removably or rigidly attached to the front portion of the helmet depending upon the user, the weather for the day, and the activity. Various constructions have been used for attaching visors to the front portion of the helmet, such as threaded inserts into the helmet to receive a screw or bolt, the use of hook and loop type fastening materials, and the provision of a hole in the helmet body into which a member is frictionally inserted. While some people may choose to wear a baseball hat underneath a helmet, this arrangement can be awkward, and the brim of the hat may not be able to be positioned in the desired manner.

It is therefore desirable to provide a helmet with a reversible visor that can quickly and easily attach and detach from a forward-facing position on the front portion of the helmet to a backward-facing position on the rear portion of the helmet.

Before proceeding to a detailed description of the invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

BRIEF SUMMARY OF THE INVENTION

In general, in a first aspect, the invention relates to a helmet having an outer protective shell having a forward-facing portion and a rearward-facing portion and an inner absorbent shell having a forward-facing portion and a rearward-facing portion. The helmet also has a visor removably attachable to the forward-facing portion and the rearward-facing portion of the outer protective shell, the inner absorbent shell, or a combination of both the outer protective shell and the inner absorbent shell.

The visor further comprises a visor coupling mechanism configured to mechanically attach the visor to the forward-facing portion and the rearward-facing portion of the outer protective shell, the inner absorbent shell, or a combination of both the outer protective shell and the inner absorbent shell. The visor coupling mechanism can be constructed with an arcuate internal upright ridge configured to wrap about the forward-facing portion of the outer shell, an arcuate external upright ridge configured to wrap about the rearward-facing portion of the outer shell, and an intermediate arcuate channel between the internal upright ridge and the external upright ridge. The internal upright ridge can include a plurality of upright attachment apertures, and the outer protective shell can a plurality of visor attachment protrusions on an inner surface thereof. The visor attachment protrusions on the inner surface of the outer protective shell are removably attachable to the upright attachment apertures of the internal upright ridge of the visor. The inner absorbent shell can include a plurality of visor attachment recesses on an exterior surface thereof, and the visor attachment recesses are configured to receive the upright attachment apertures of the internal upright ridge of the visor when attached to the visor attachment protrusions on the inner surface of the outer protective shell. In addition, terminal ends of the forward-facing portion and the rearward-facing portion of the outer protective shell are both configured to seat within the intermediate arcuate channel of the visor coupling mechanism.

In general, in a second aspect, the invention relates to a protective helmet having an outer protective shell having a forward-facing portion and a rearward-facing portion and an inner absorbent shell having a forward-facing portion and a rearward-facing portion. A visor is removably attachable to the forward-facing portion and the rearward-facing portion of the outer protective shell, the inner absorbent shell, or a combination of both the outer protective shell and the inner absorbent shell. A visor coupling mechanism is configured to mechanically attach the visor to the forward-facing portion and the rearward-facing portion of the outer protective shell, the inner absorbent shell, or a combination of both the outer protective shell and the inner absorbent shell. The visor coupling mechanism also includes an arcuate internal upright ridge configured to wrap about the forward-facing portion of the outer shell, an arcuate external upright ridge configured to wrap about the rearward-facing portion of the outer shell, and an intermediate arcuate channel between the internal upright ridge and the external upright ridge. Terminal ends of the forward-facing portion and the rearward-facing portion of the outer protective shell are each configured to seat within the intermediate arcuate channel of the visor coupling mechanism.

In accordance with the first or second aspect of the invention disclosed above, an outer surface of the outer protective shell may be configured as a baseball cap having a plurality of panels, a plurality of vent holes, or both. The inner absorbent shell can have a plurality of vent holes coaxially spaced from and axially aligned with the vent holes in the outer protective shell. In addition, the visor can be configured as a flat brim visor, a bent brim visor, or an extra bent brim visor. Further, the helmet can have five panels or six panels, each of which is separated by a seam or groove. Lastly, the helmet can include a chin or neck strap, a fit adjustment assembly, or both.

The visor coupling mechanism can also include clips, flaps, clamps, pins, appendages, plugs, threaded inserts into the helmet to receive a screw or bolt, the use of hook and loop type fastening materials, the provision of a hole in the helmet into which a member is frictionally inserted, or a combination thereof.

The foregoing has outlined in broad terms some of the more important features of the invention disclosed herein so that the detailed description that follows may be more clearly understood, and so that the contribution of the named inventors to the art may be better appreciated. The invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, the phraseology and terminology employed herein are for the purpose of description and should not be regarded as limiting, unless the specification specifically so limits the invention.

BRIEF DESCRIPTION OF THE DRAWINGS

The accompanying drawings, which are incorporated in and constitute part of this specification, illustrate embodiments of the invention and together with the description, explain the principles of the disclosed embodiments, it being understood, however, that the invention is not limited to the precise arrangements and instrumentalities shown.

DETAILED DESCRIPTION OF THE INVENTION

Figure 1:
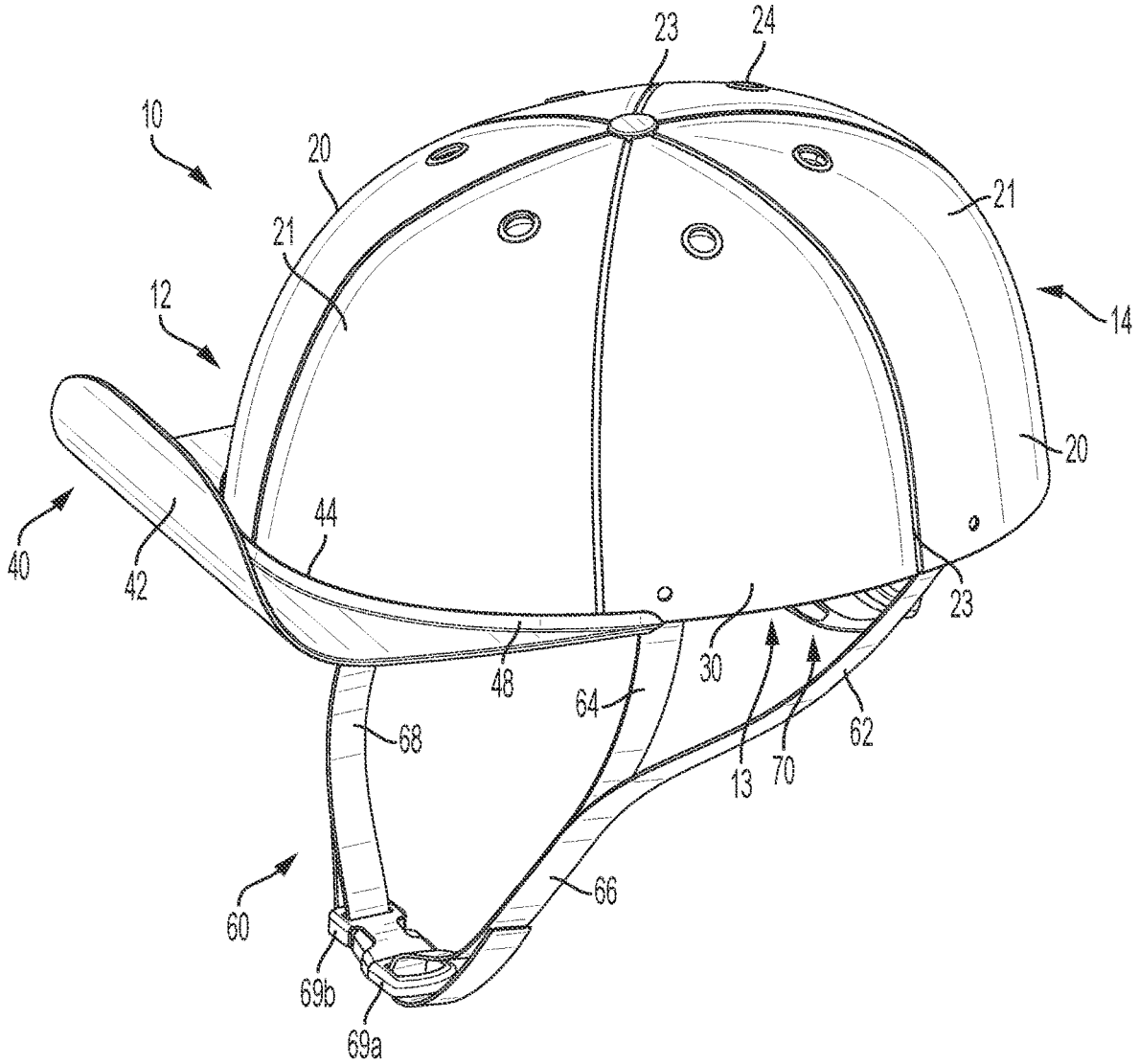
FIG. 1 is a front perspective view of an example of a helmet with an upwardly extra bent brimmed visor removably coupled thereon in a forward-facing position in accordance with an illustrative embodiment of the invention disclosed herein.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular protective helmets are disclosed, such protective helmets and implementing components may comprise any shape, size, style, type, model, version, measurement, concentration, material, quantity, and/or the like as is known in the art for such protective helmets and implementing components, consistent with the intended operation of a protective helmet.

While this disclosure includes a number of embodiments in many different forms, there is shown in the drawings and will herein be described in detail, particular embodiments with the understanding that the present disclosure is to be considered as an exemplification of the principles of the disclosed methods and systems and is not intended to limit the broad aspect of the disclosed concepts to the embodiments illustrated.

Figure 8:
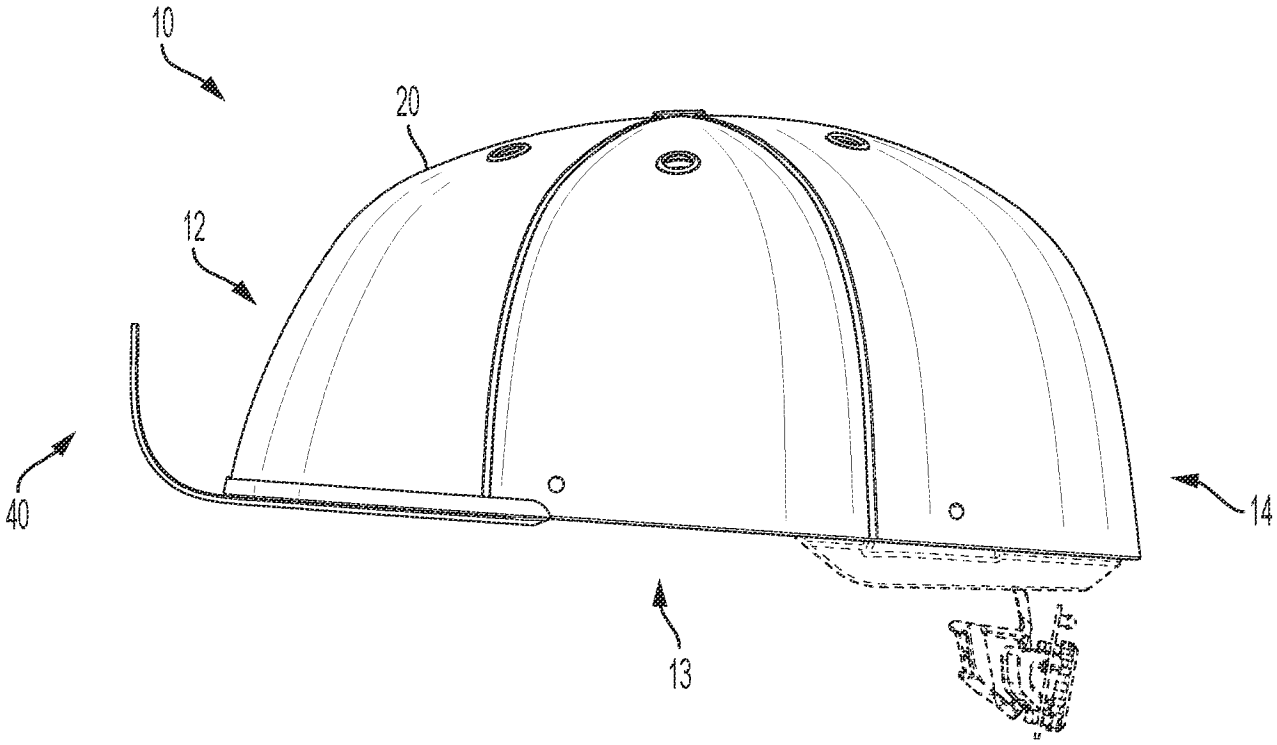
FIG. 8 is a first side elevation view of the helmet and the extra bent brimmed visor shown in FIG. 1.
Figure 9:
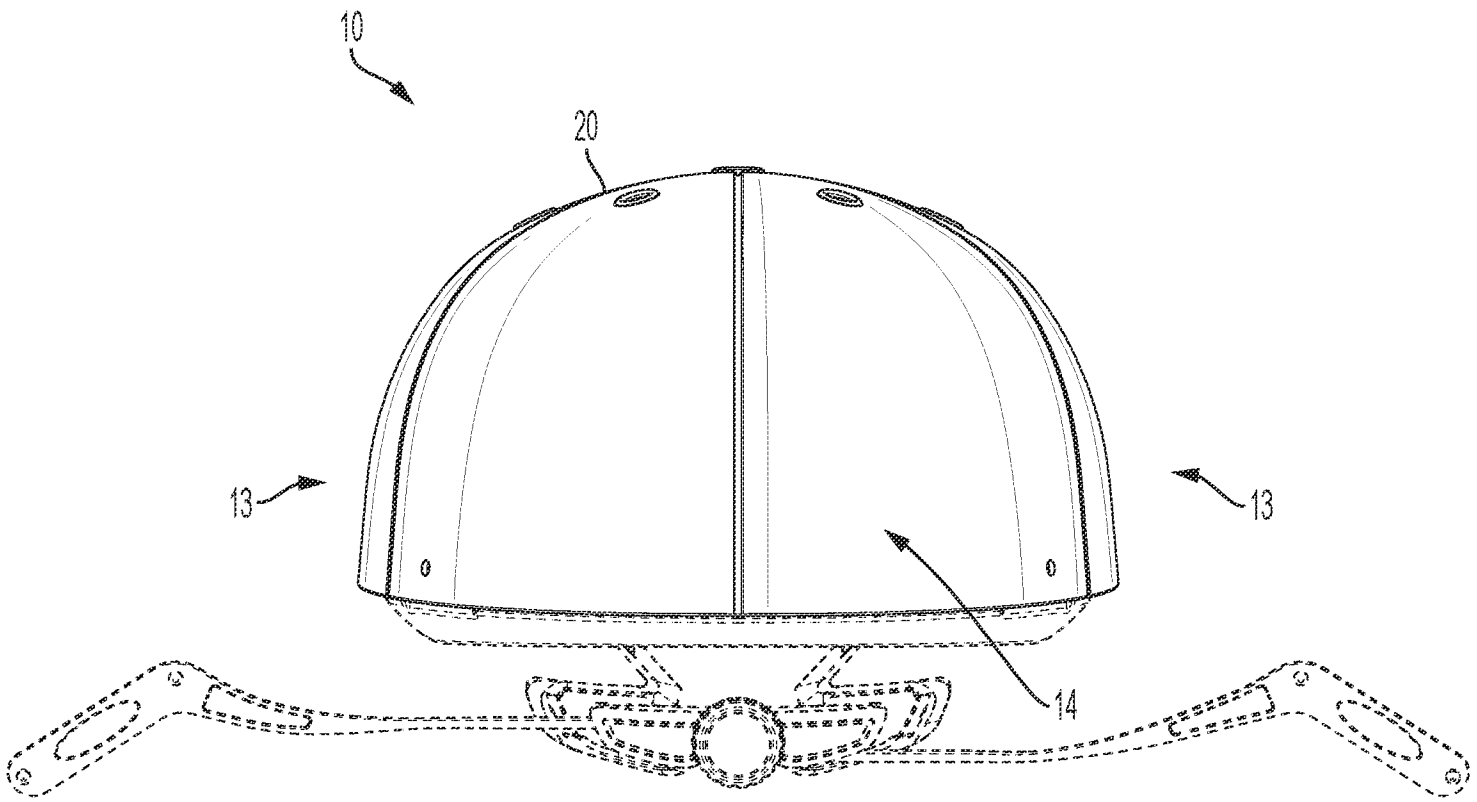
FIG. 9 is a rear elevation view of the helmet and the extra bent brimmed visor shown in FIG. 1.
Figure 10:
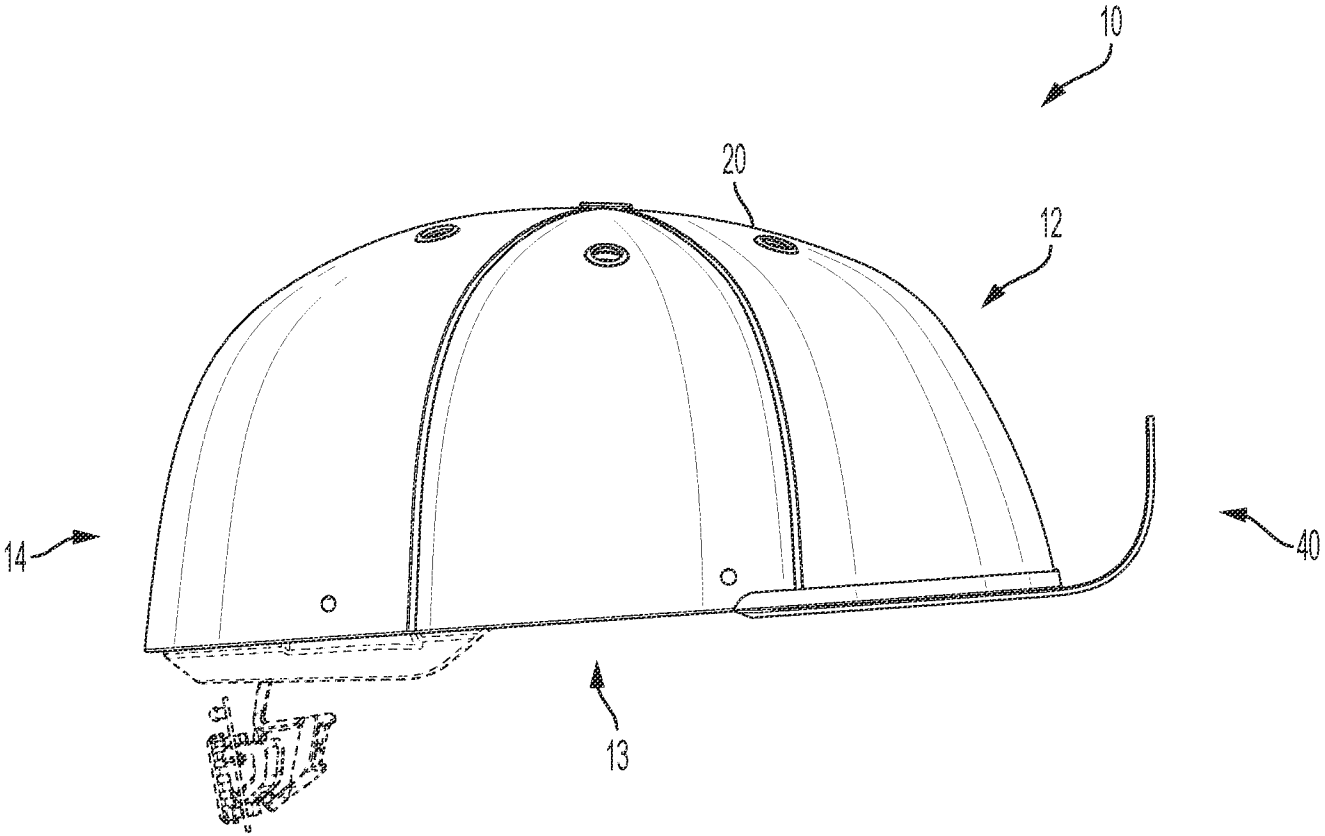
FIG. 10 is a second side elevation view of the helmet and the extra bent brimmed visor shown in FIG. 1.
Figure 11:
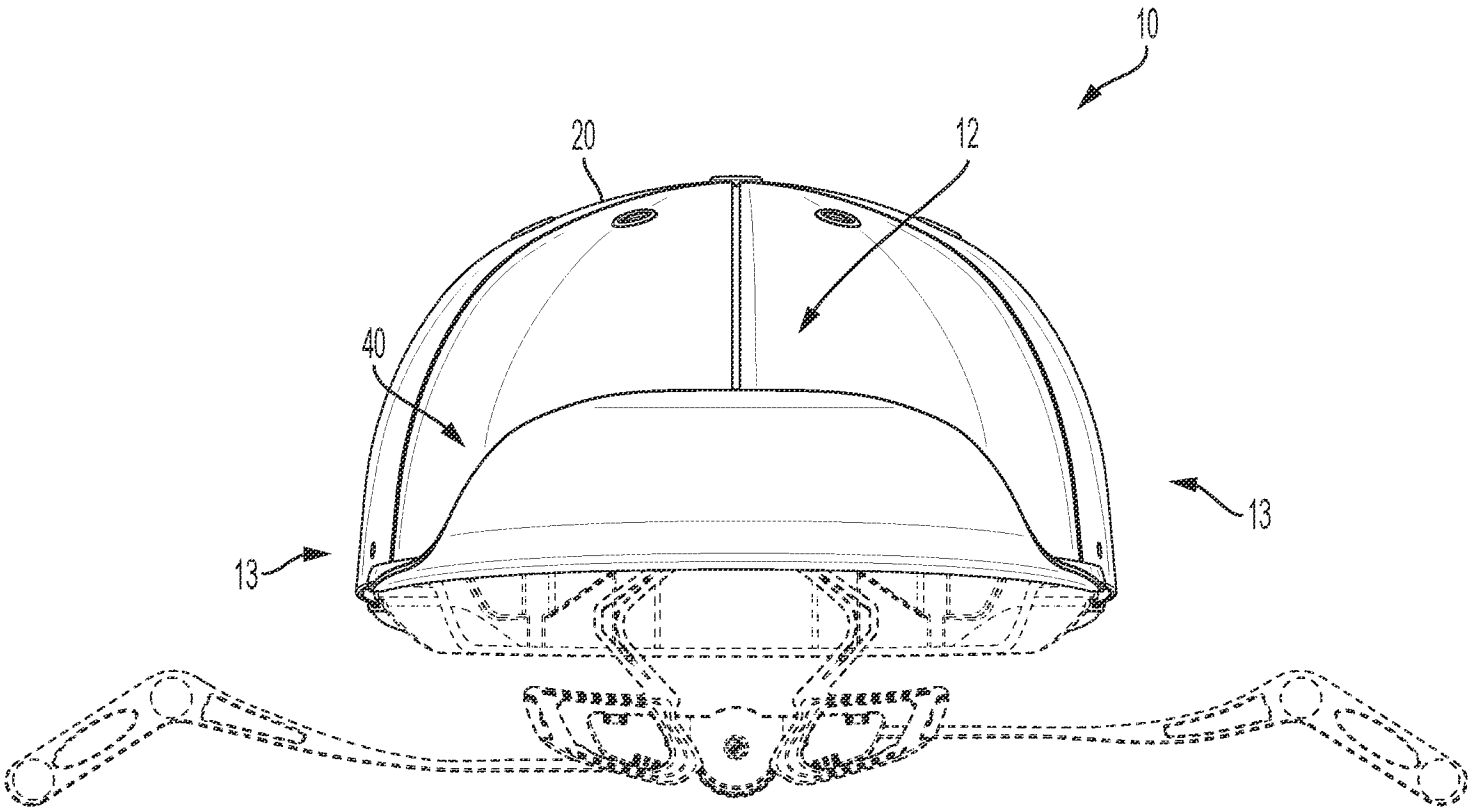
FIG. 11 is a front elevation view of the helmet and the extra bent brimmed visor shown in FIG. 1.
Figure 12:
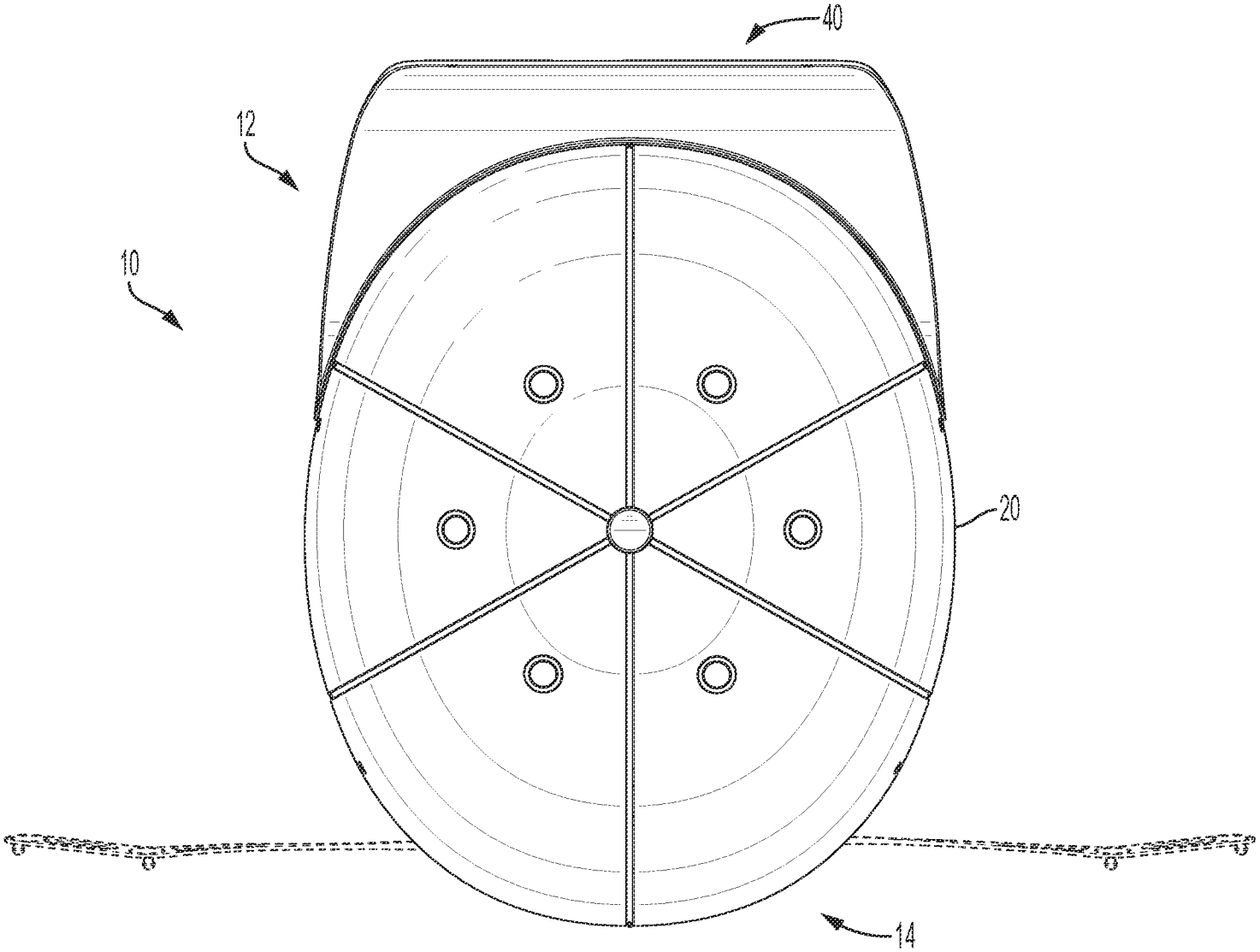
FIG. 12 is a top plan view of the helmet and the extra bent brimmed visor shown in FIG. 1.
Figure 13:
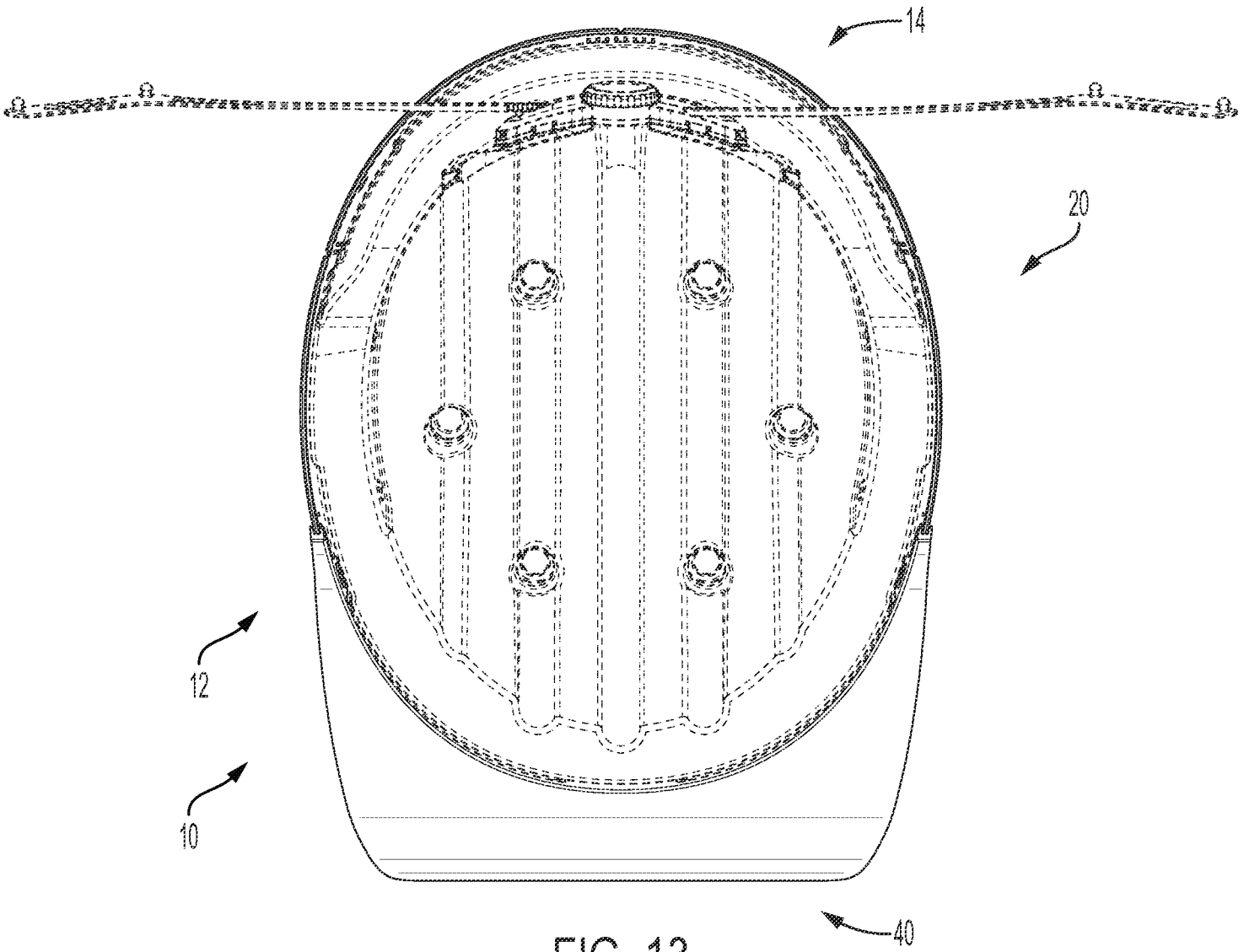
FIG. 13 is a bottom plan view of the helmet and the extra bent brimmed visor shown in FIG. 1.
Figure 14:
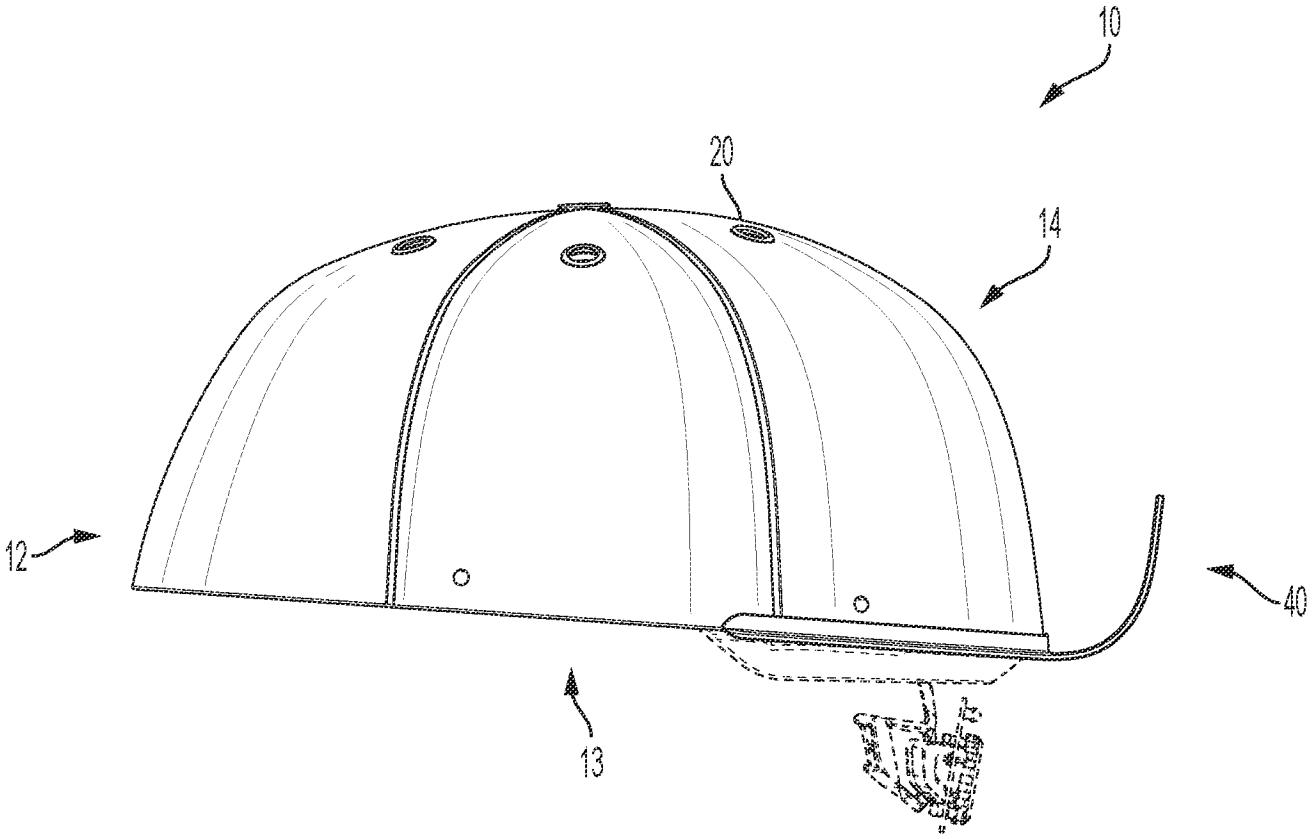
FIG. 14 is a side elevation view of the helmet with the extra bent brimmed visor shown in FIG. 1 removably coupled thereon in a rearward-facing position in accordance with an illustrative embodiment of the invention disclosed herein.
Figure 15:
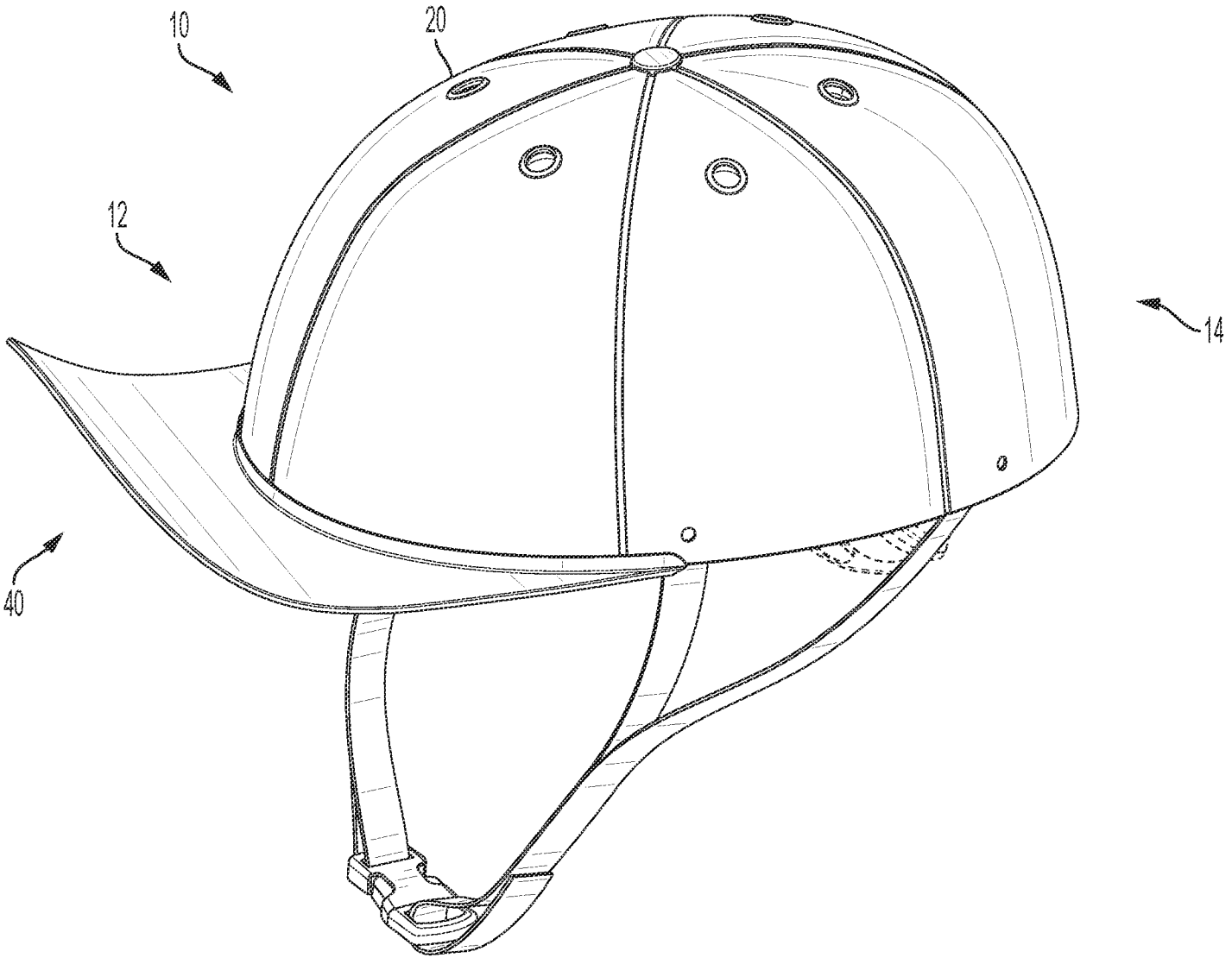
FIG. 15 is a perspective view of a helmet with an upwardly bent brimmed visor removably coupled thereto in a forward-facing position in accordance with an illustrative embodiment of the invention disclosed herein.
Figure 16:
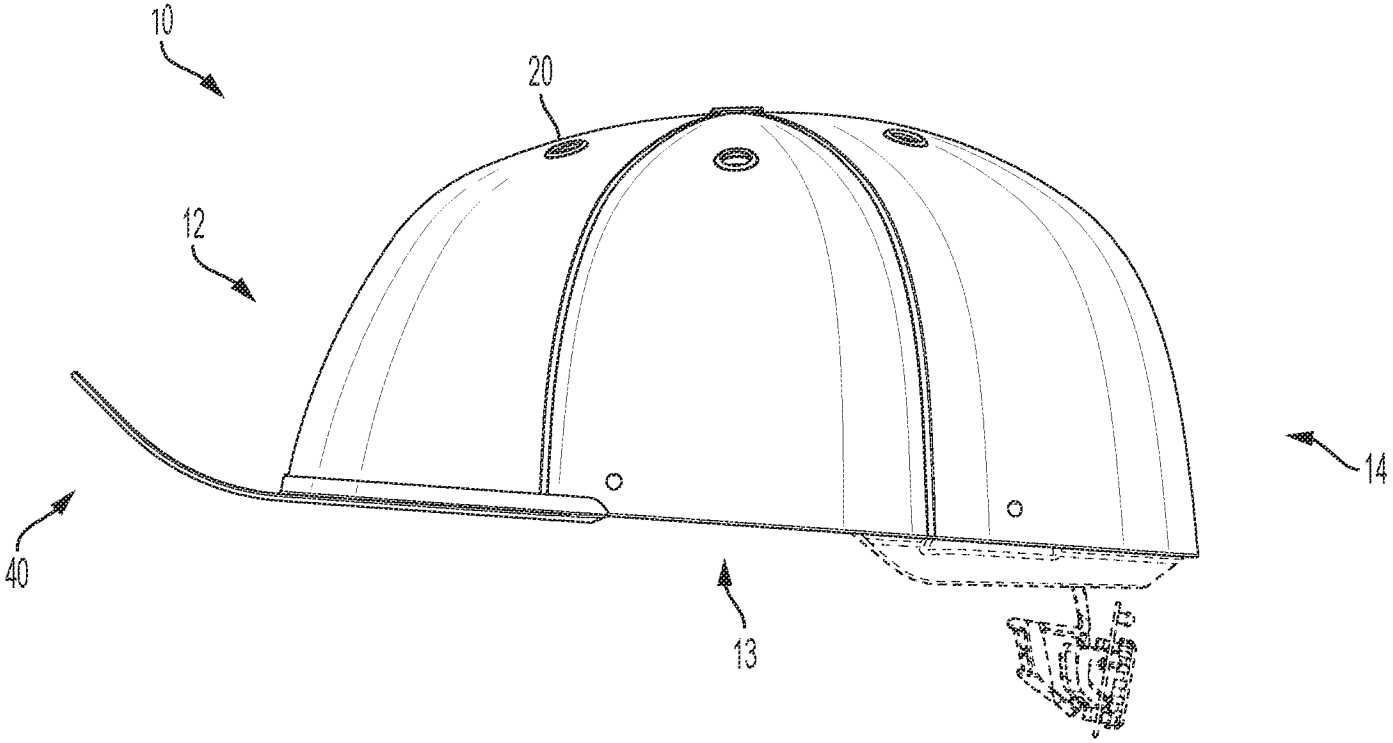
FIG. 16 is a first side elevation view of the helmet and the bent brimmed visor shown in FIG. 15.
Figure 17:
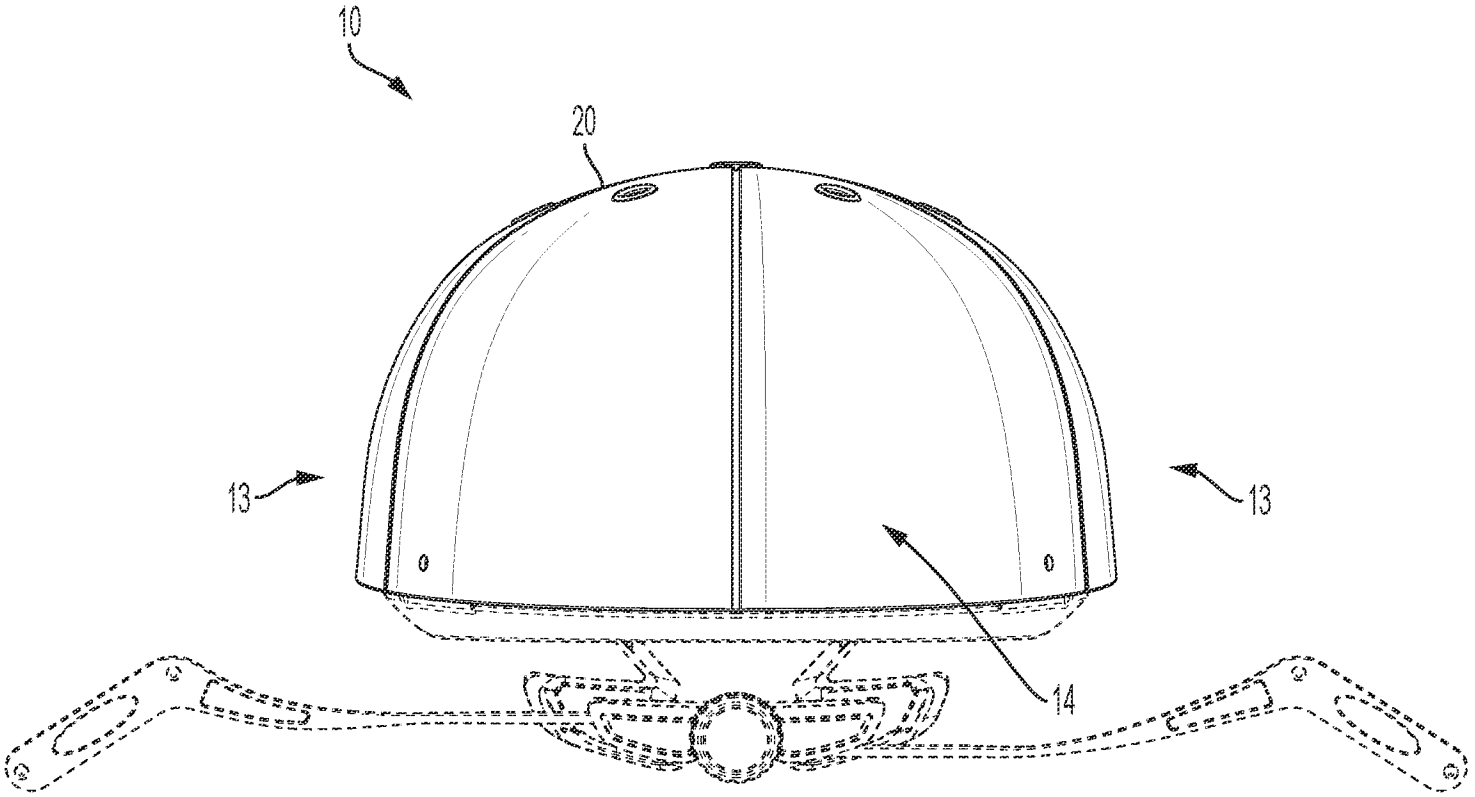
FIG. 17 is a rear elevation view of the helmet and the bent brimmed visor shown in FIG. 15.
Figure 18:
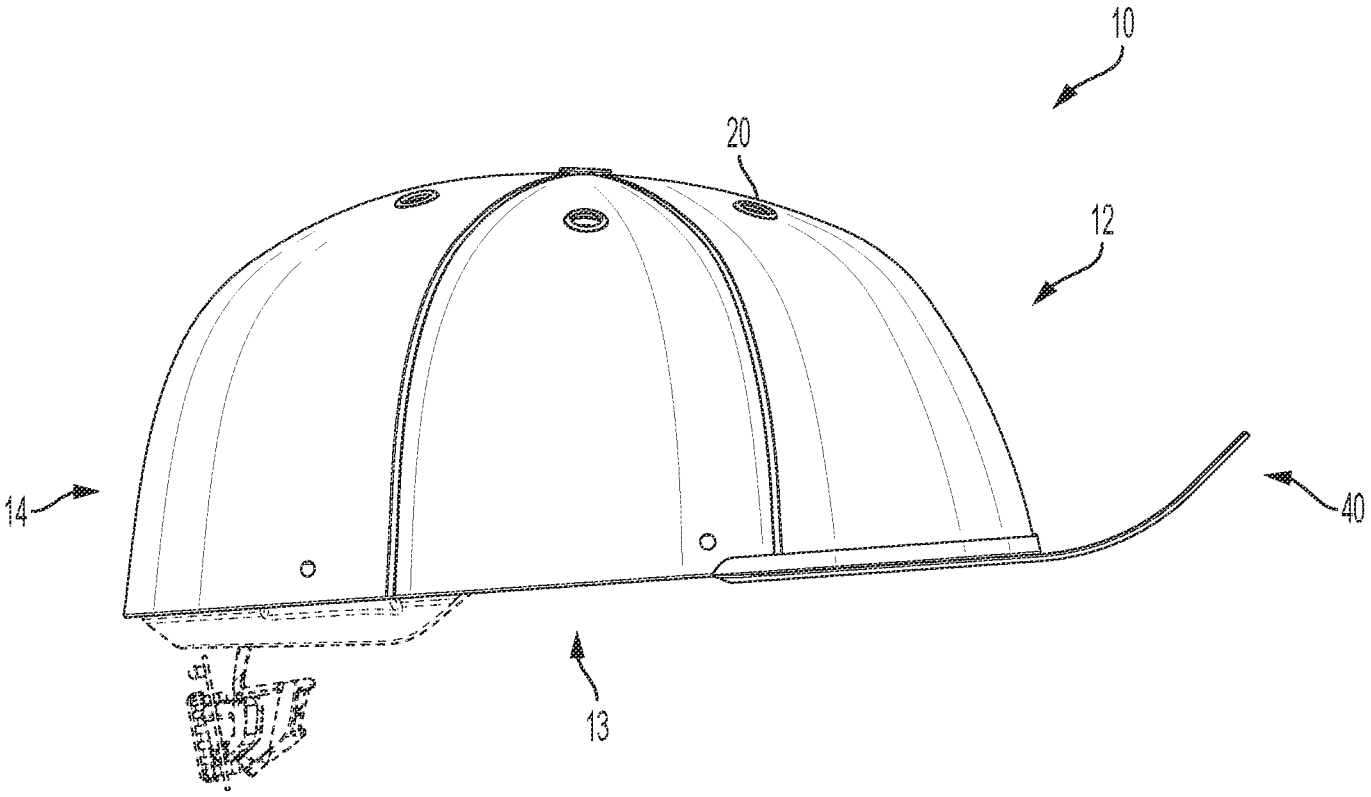
FIG. 18 is a second side elevation view of the helmet and the bent brimmed visor shown in FIG. 15.
Figure 19:
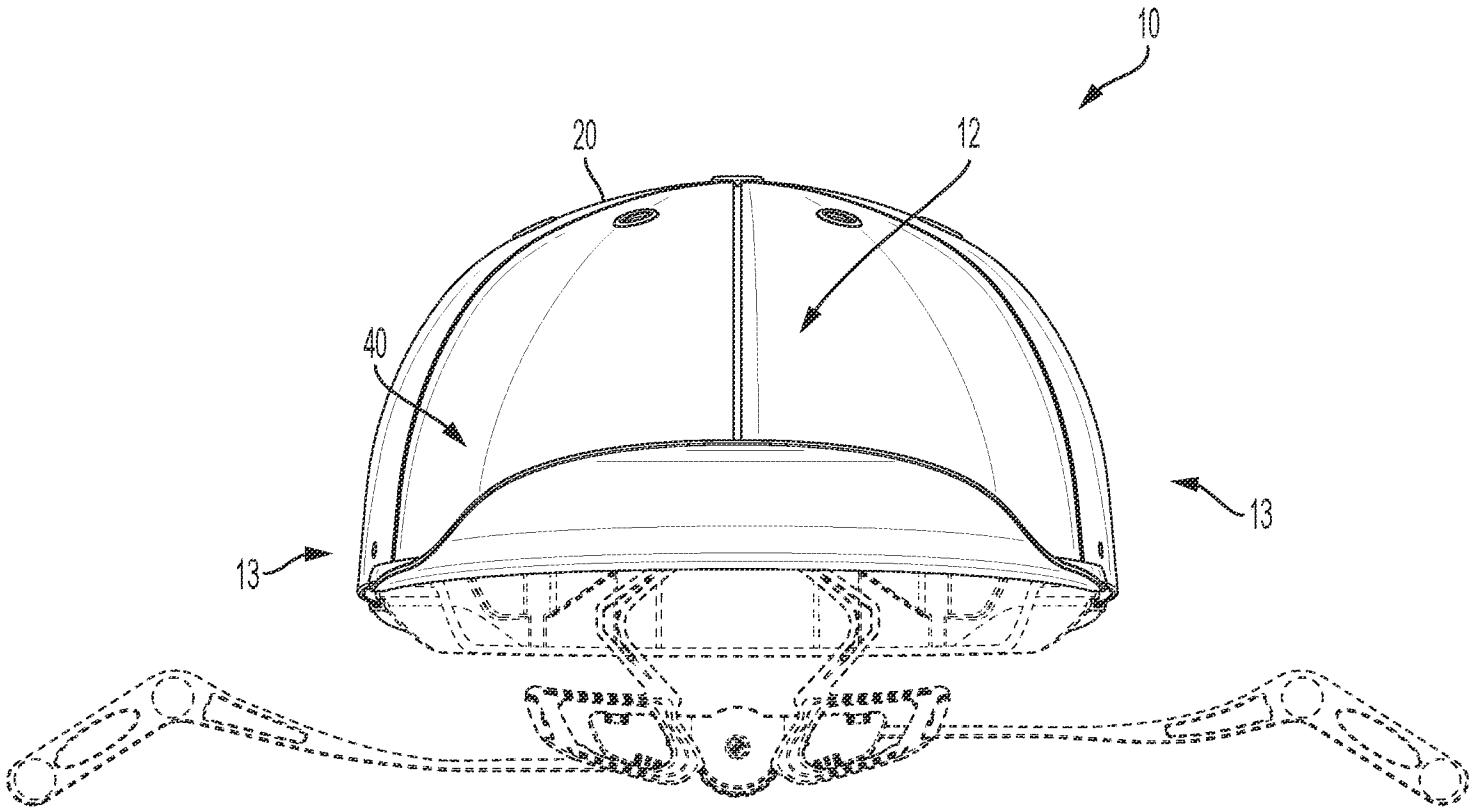
FIG. 19 is a front elevation view of the helmet and the bent brimmed visor shown in FIG. 15.
Figure 20:
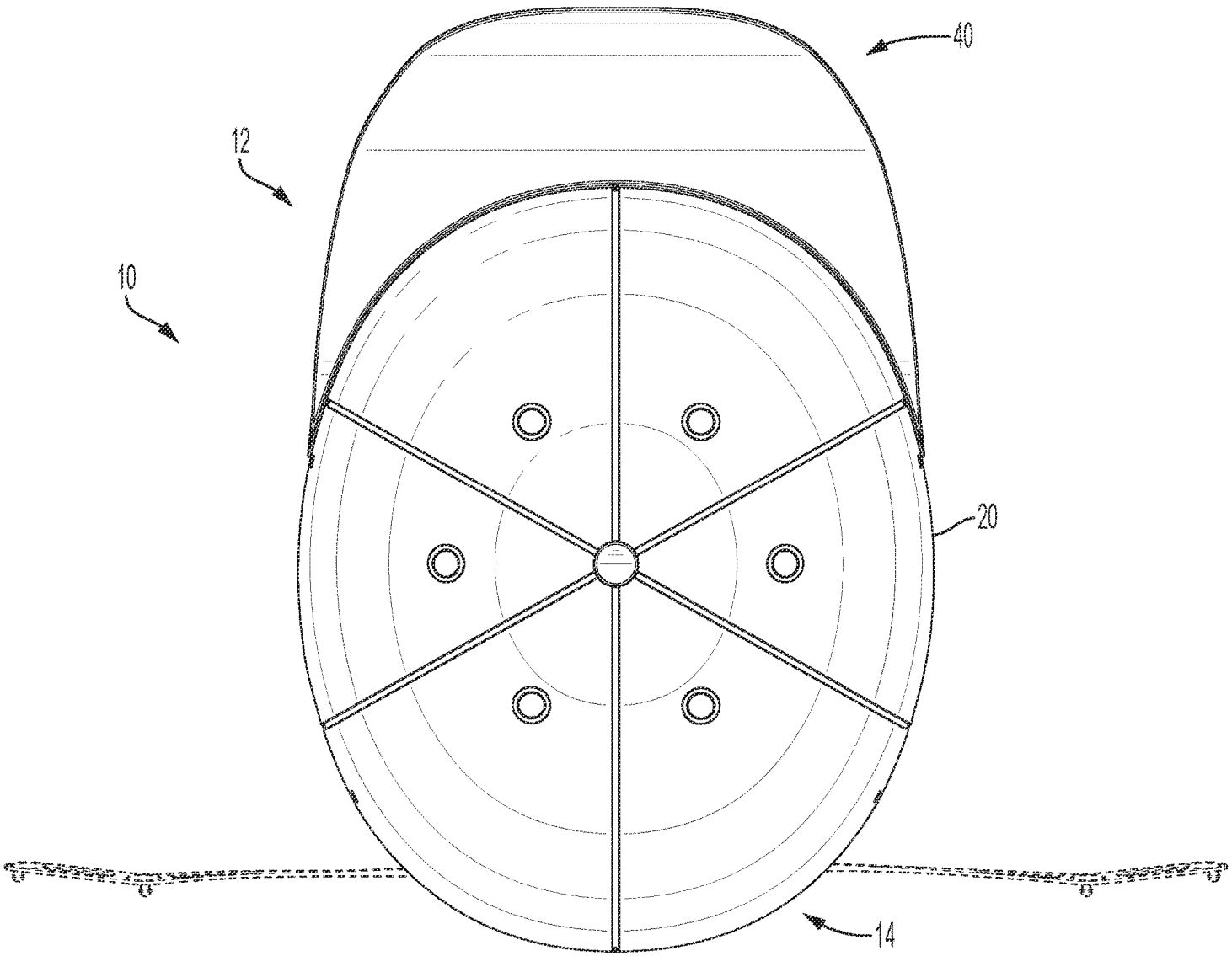
FIG. 20 is a top plan view of the helmet and the bent brimmed visor shown in FIG. 15.
Figure 21:
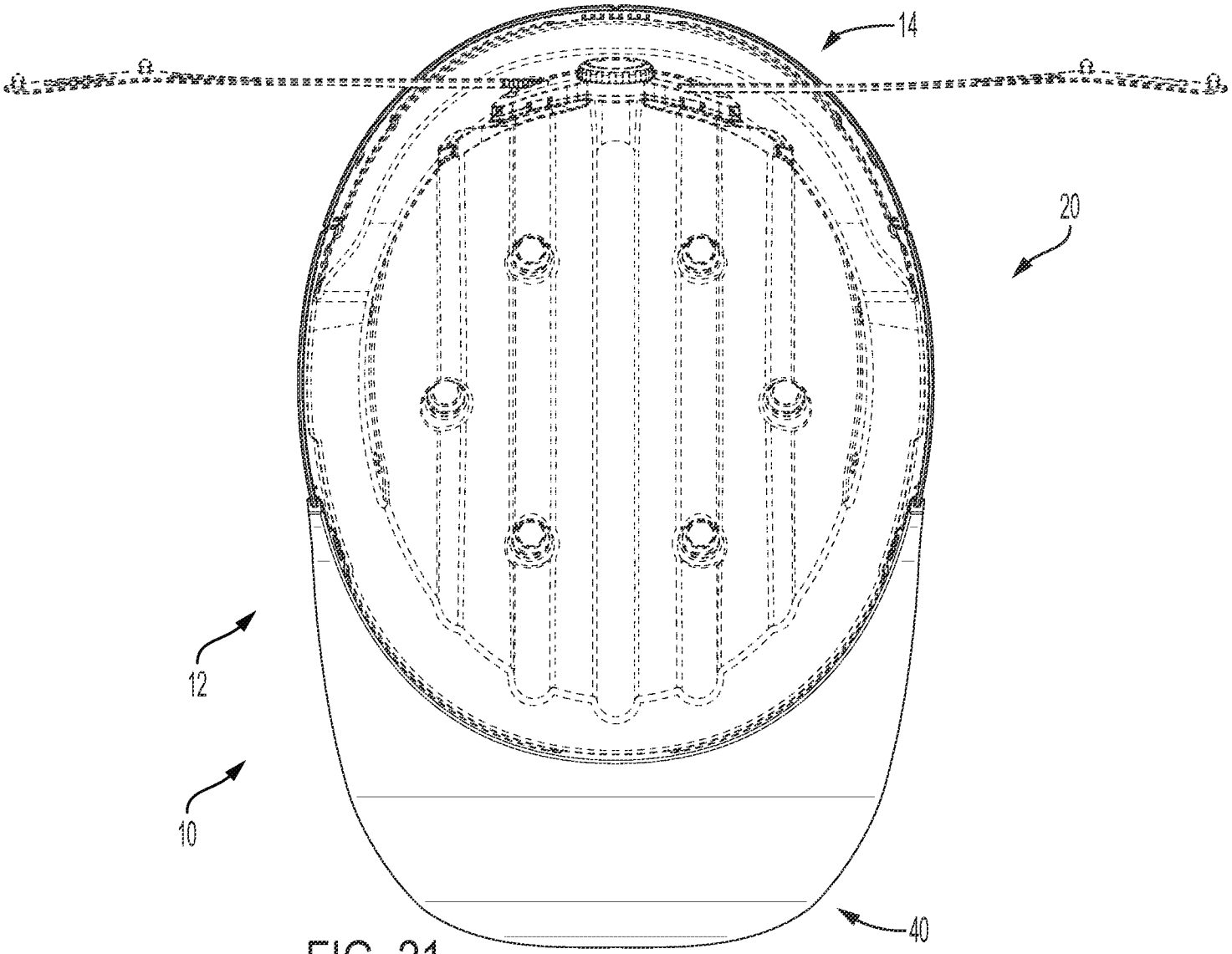
FIG. 21 is a bottom plan view of the helmet and the bent brimmed visor shown in FIG. 15.
Figure 22:
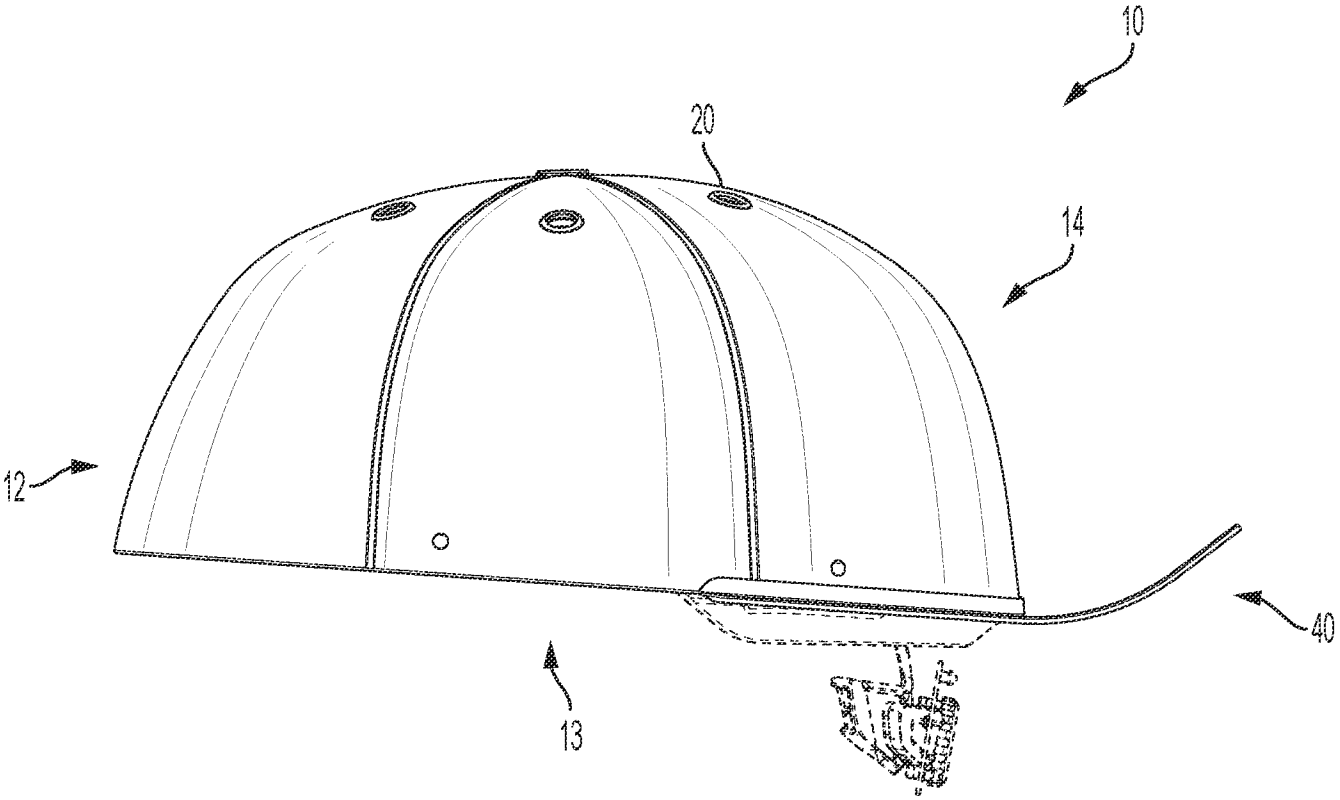
FIG. 22 is a side elevation view of the helmet with the bent brimmed visor shown in FIG. 15 removably coupled thereon in a rearward-facing position in accordance with an illustrative embodiment of the invention disclosed herein.
Figure 23:
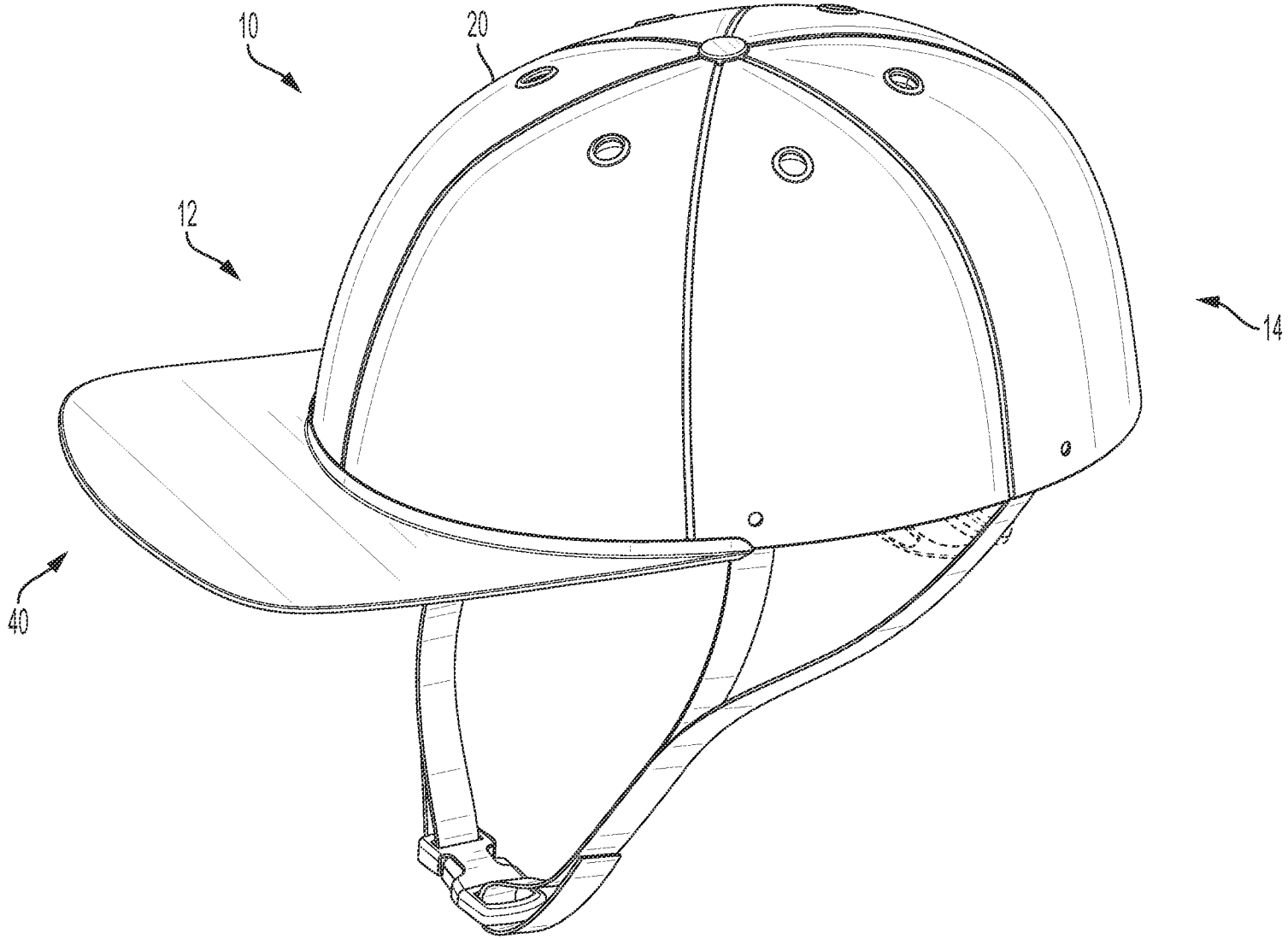
FIG. 23 is a perspective view of a helmet with a flat brimmed visor removably coupled thereto in a forward-facing position in accordance with an illustrative embodiment of the invention disclosed herein.
Figure 24:
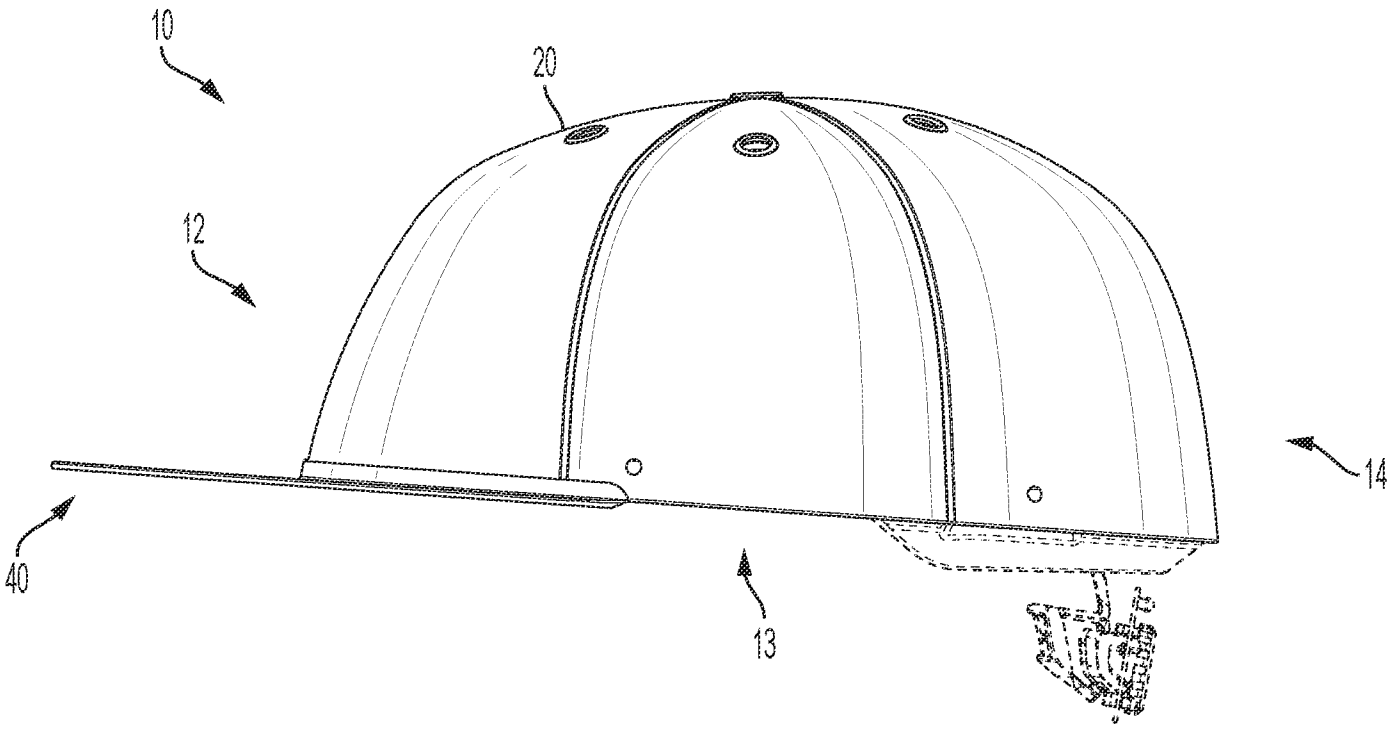
FIG. 24 is a first side elevation view of the helmet and the flat brimmed visor shown in FIG. 23.
Figure 25:
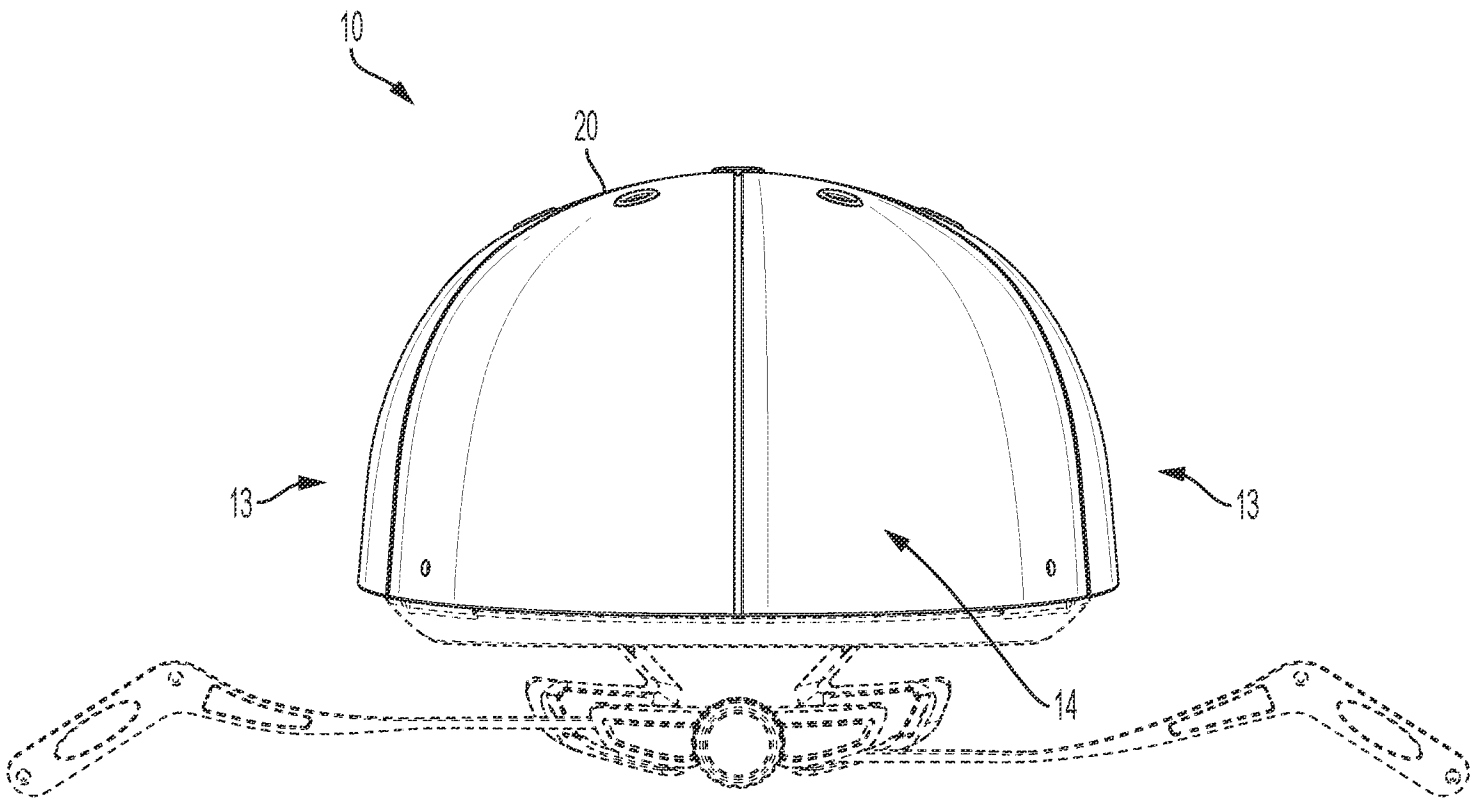
FIG. 25 is a rear elevation view of the helmet and the flat brimmed visor shown in FIG. 23.
Figure 26:
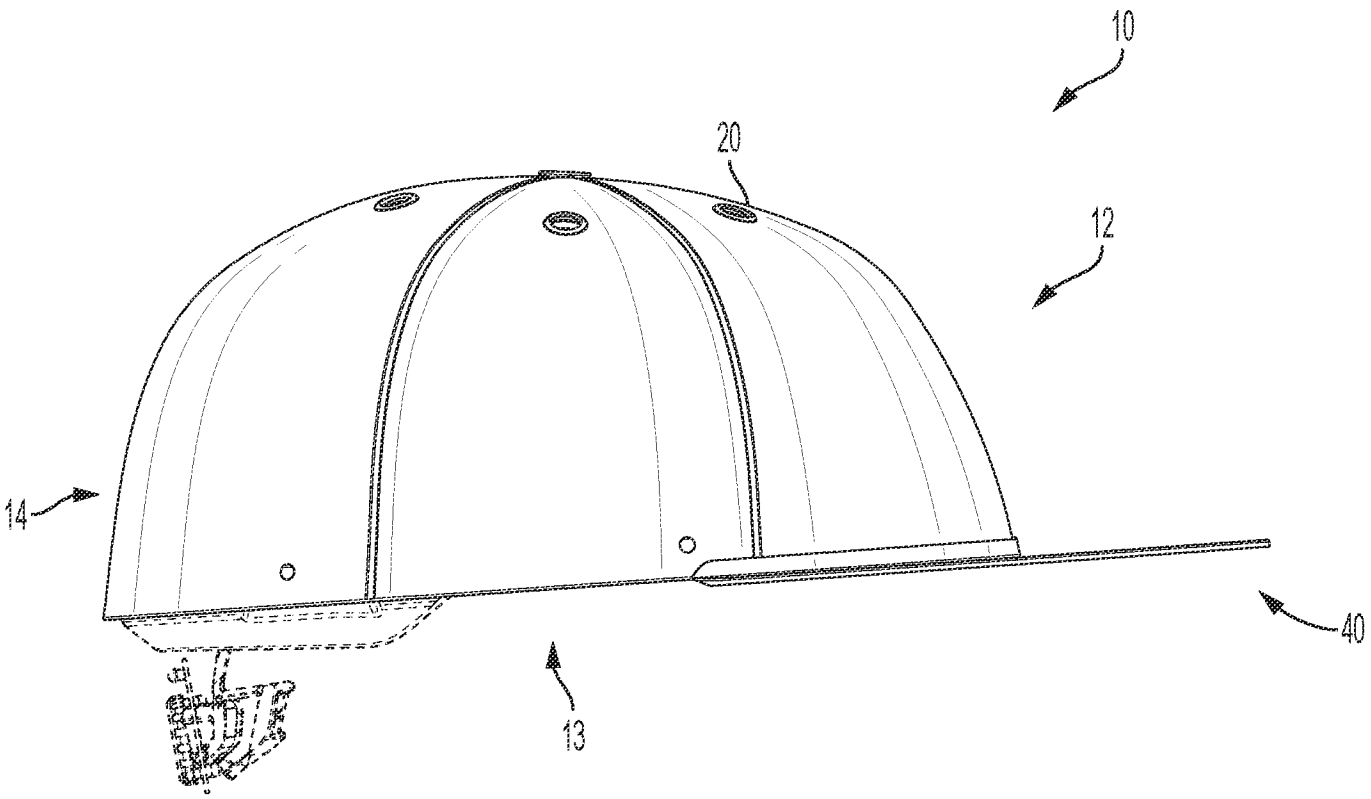
FIG. 26 is a second side elevation view of the helmet and the flat brimmed visor shown in FIG. 23.
Figure 27:
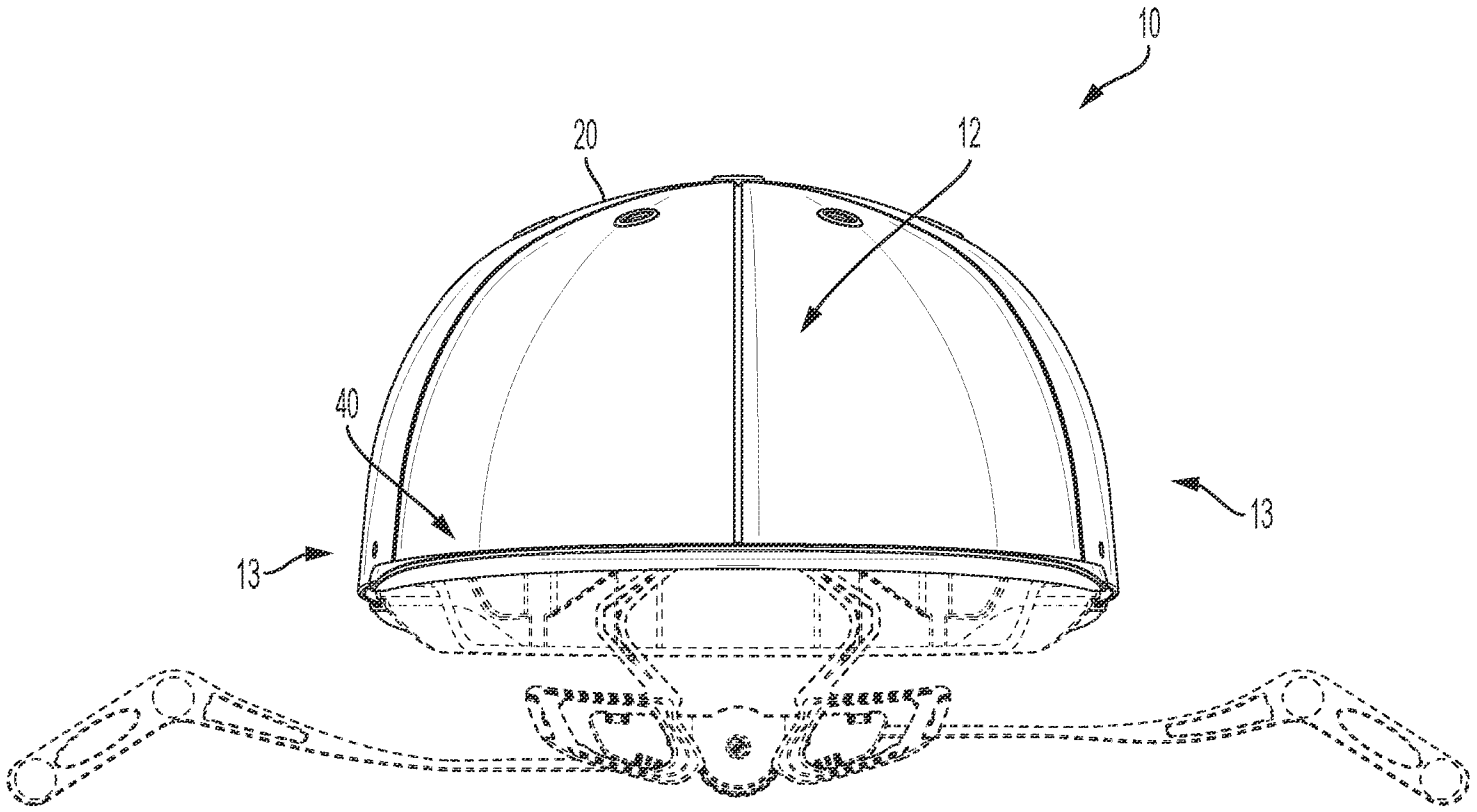
FIG. 27 is a front elevation view of the helmet and the flat brimmed visor shown in FIG. 23.
Figure 28:
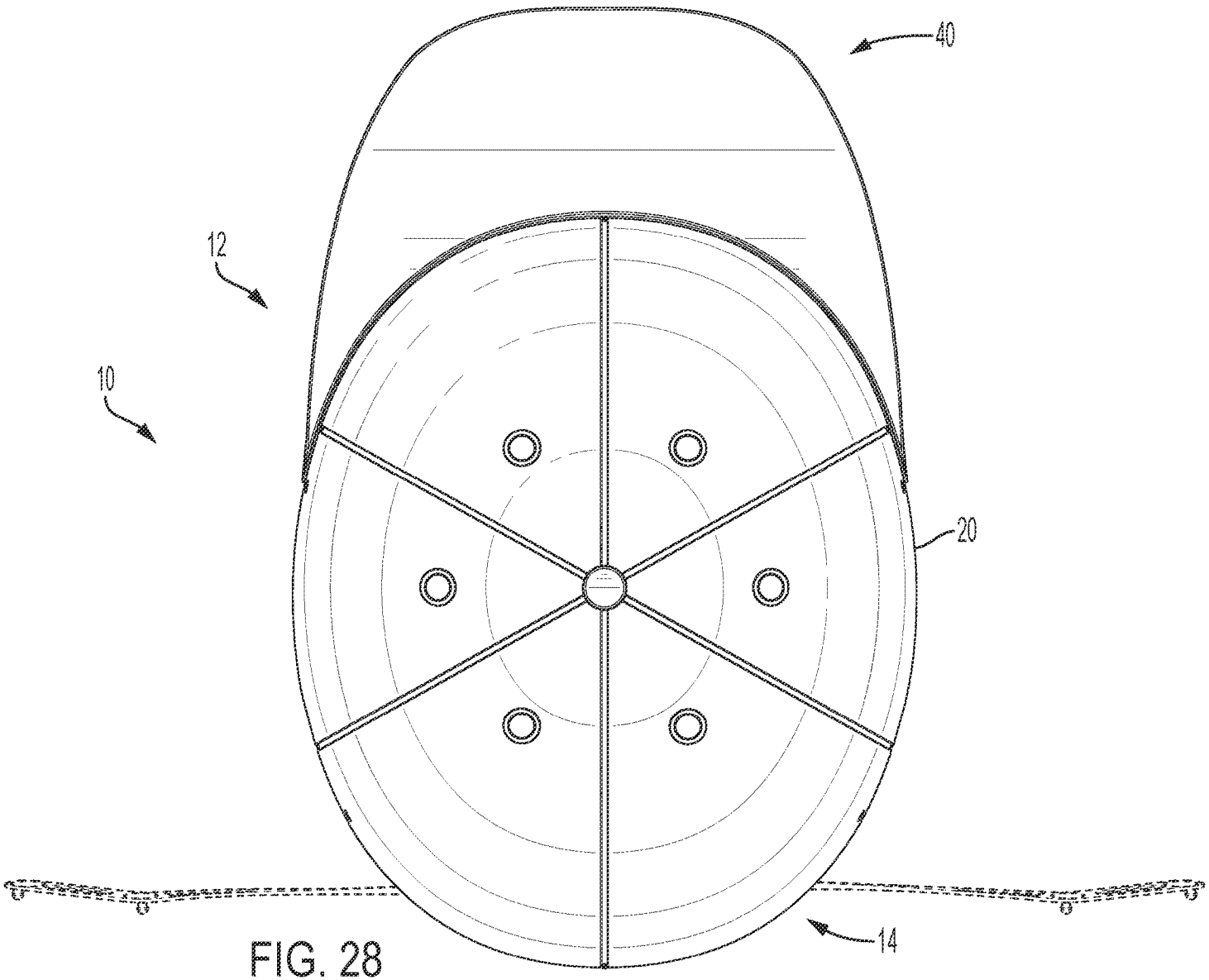
FIG. 28 is a top plan view of the helmet and the flat brimmed visor shown in FIG. 24.
Figure 29:
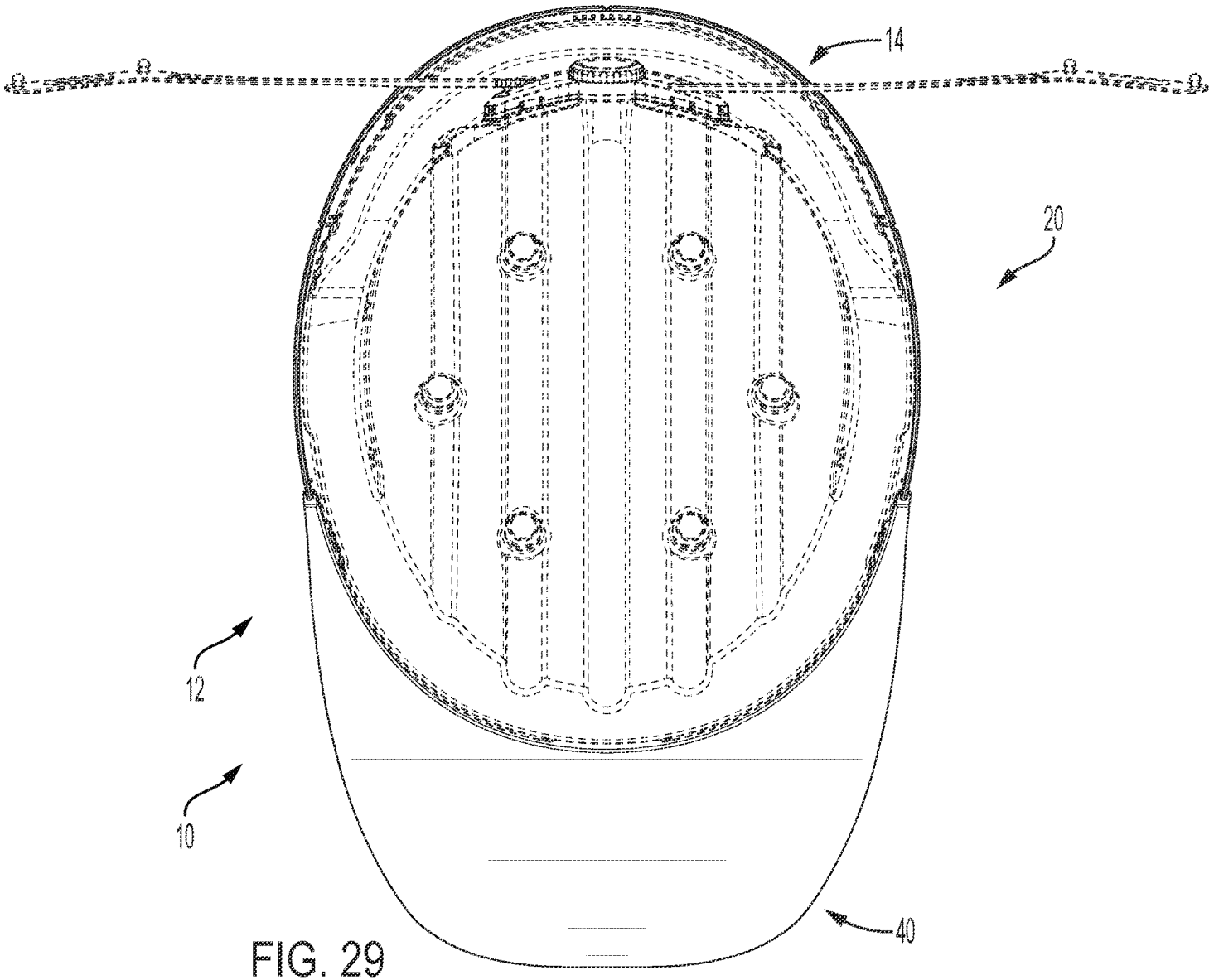
FIG. 29 is a bottom plan view of the helmet and the flat brimmed visor shown in FIG. 24.
Figure 30:
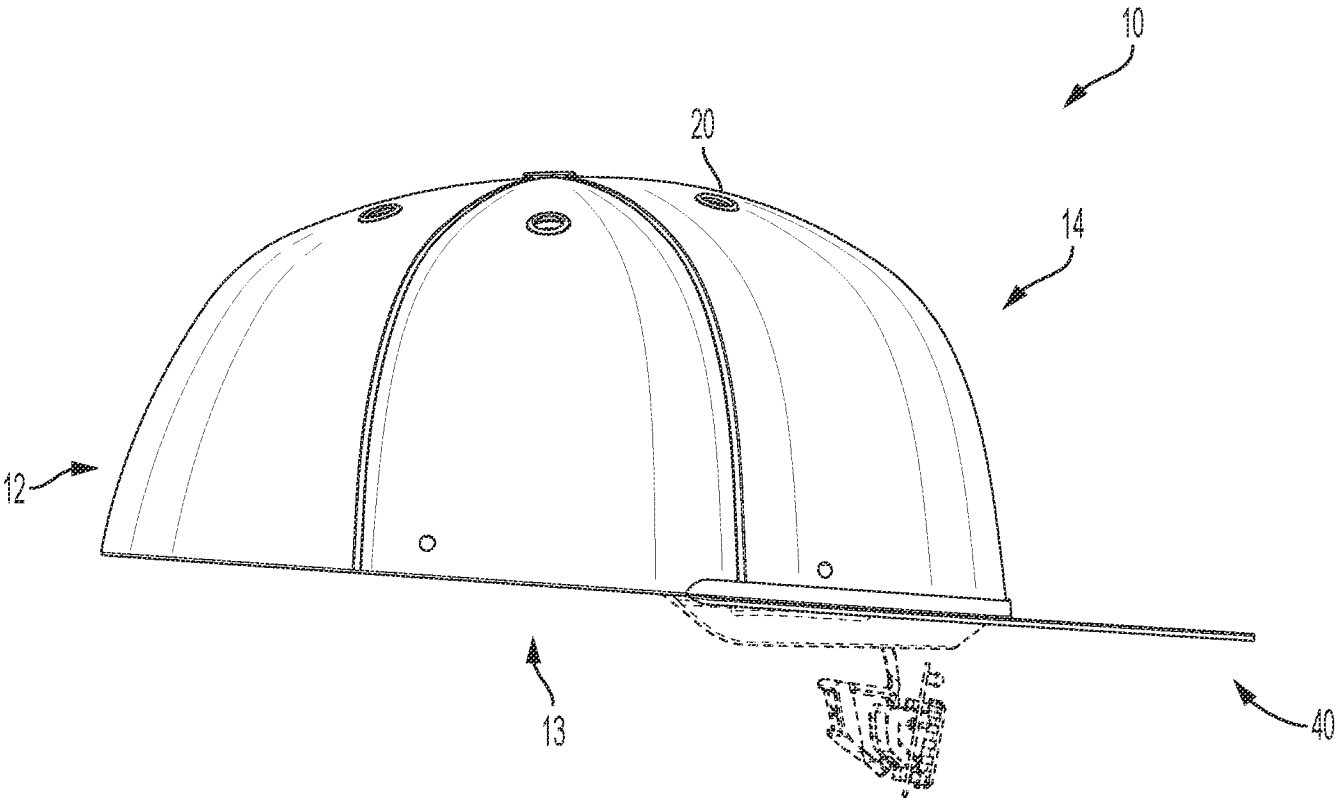
FIG. 30 is a side elevation view of the helmet with the flat brimmed visor shown in FIG. 24 removably coupled thereon in a rearward-facing position in accordance with an illustrative embodiment of the invention disclosed herein.
Figure 31:
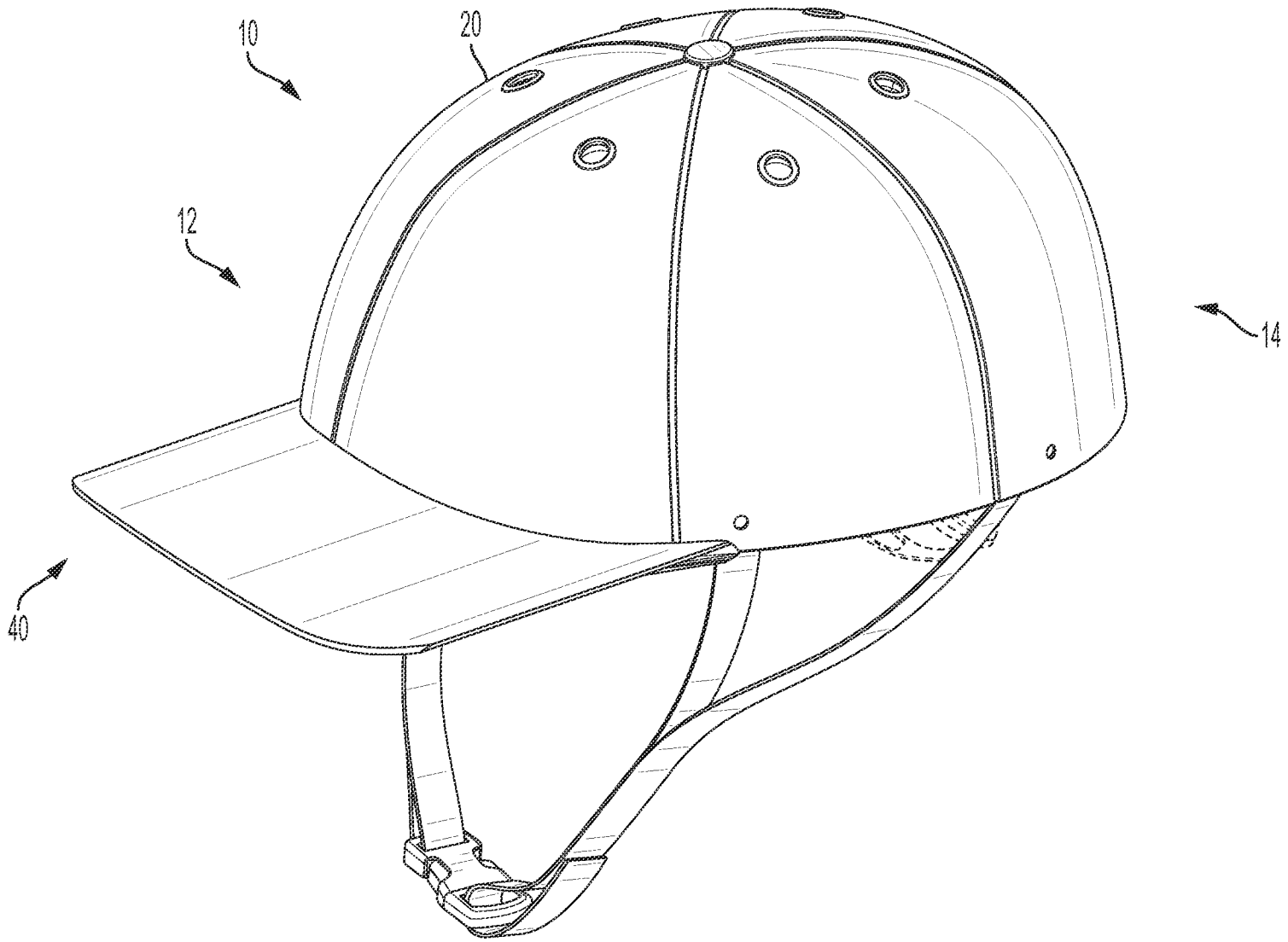
FIG. 31 is a perspective view of a helmet with a curved brimmed visor removably coupled thereto in a forward-facing position in accordance with an illustrative embodiment of the invention disclosed herein.
Figure 32:
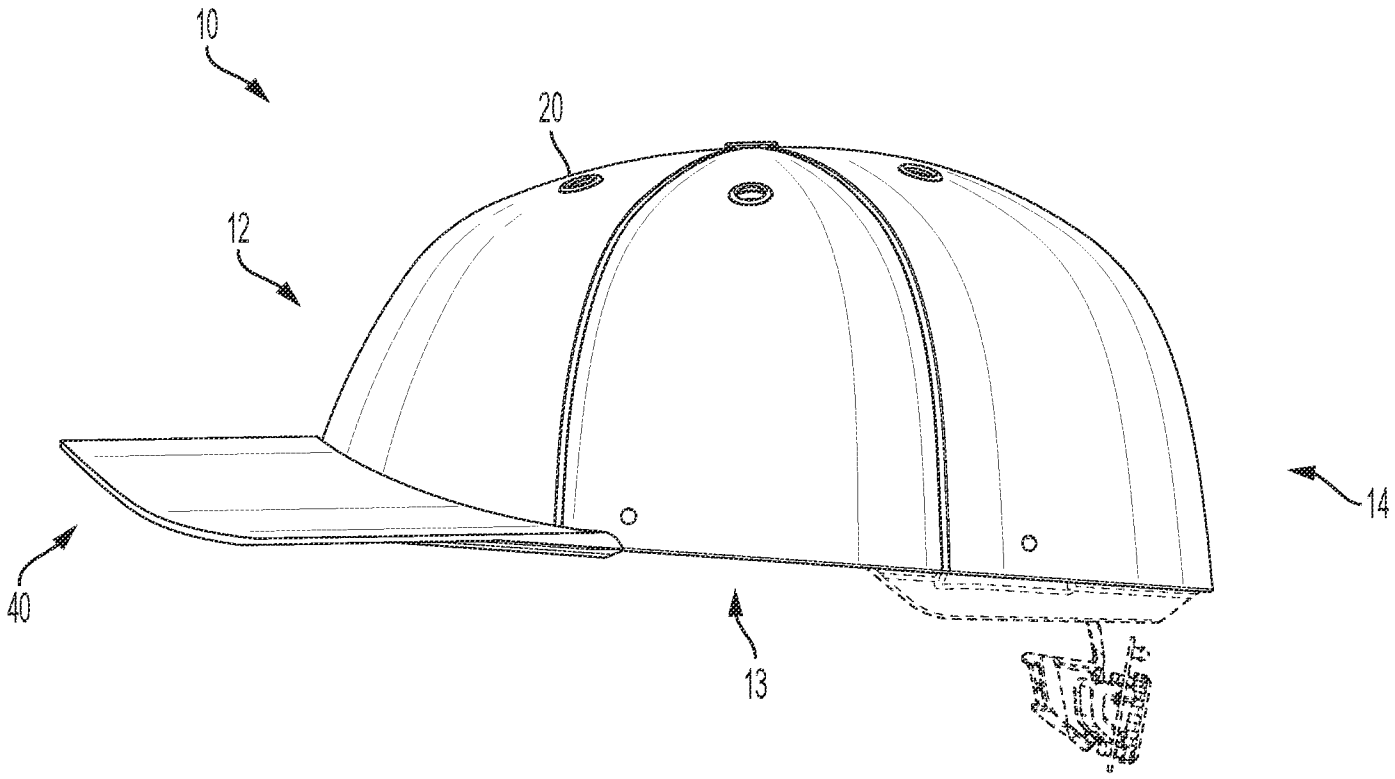
FIG. 32 is a first side elevation view of the helmet and the curved brimmed visor shown in FIG. 31.
Figure 33:
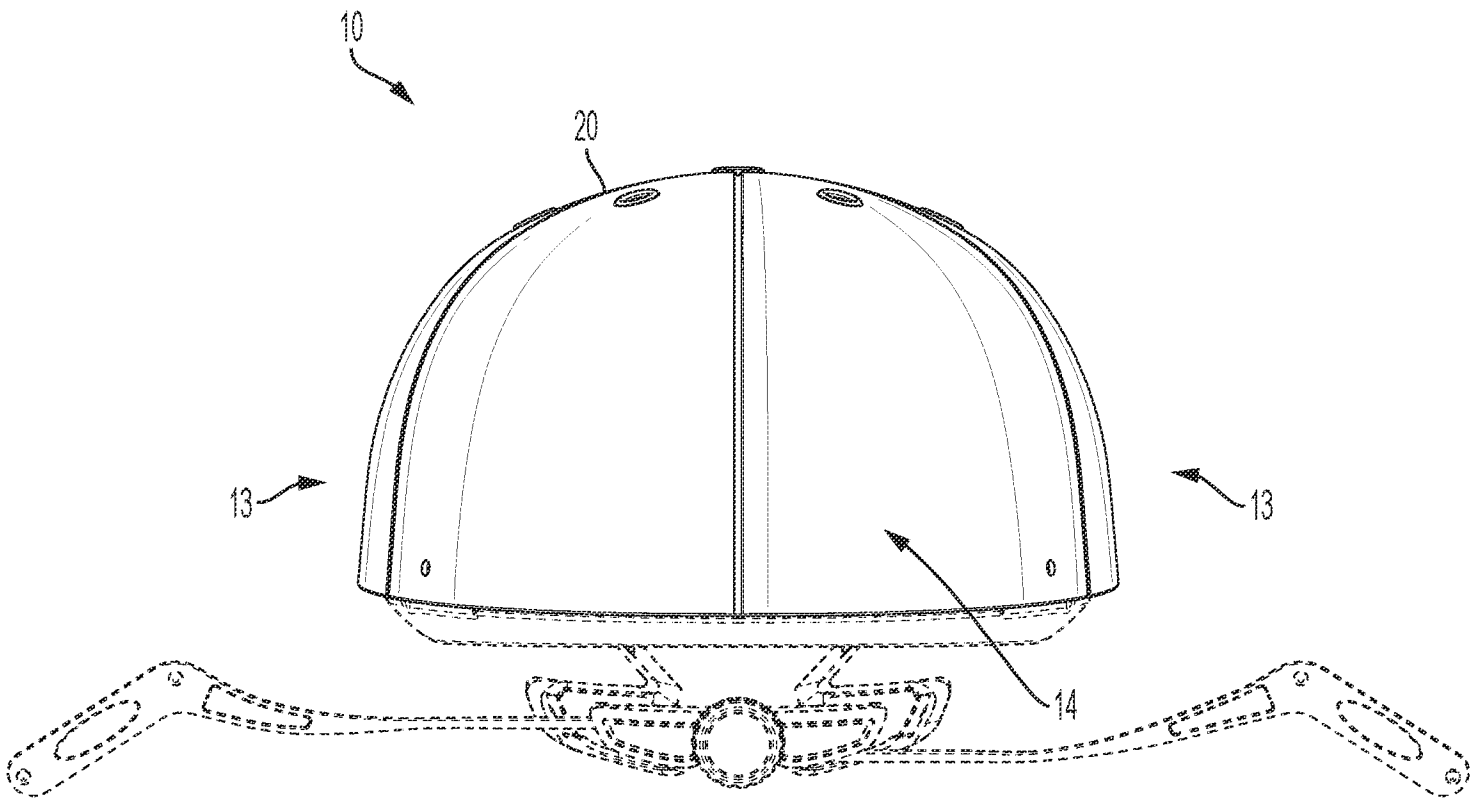
FIG. 33 is a rear elevation view of the helmet and the curved brimmed visor shown in FIG. 31.
Figure 34:
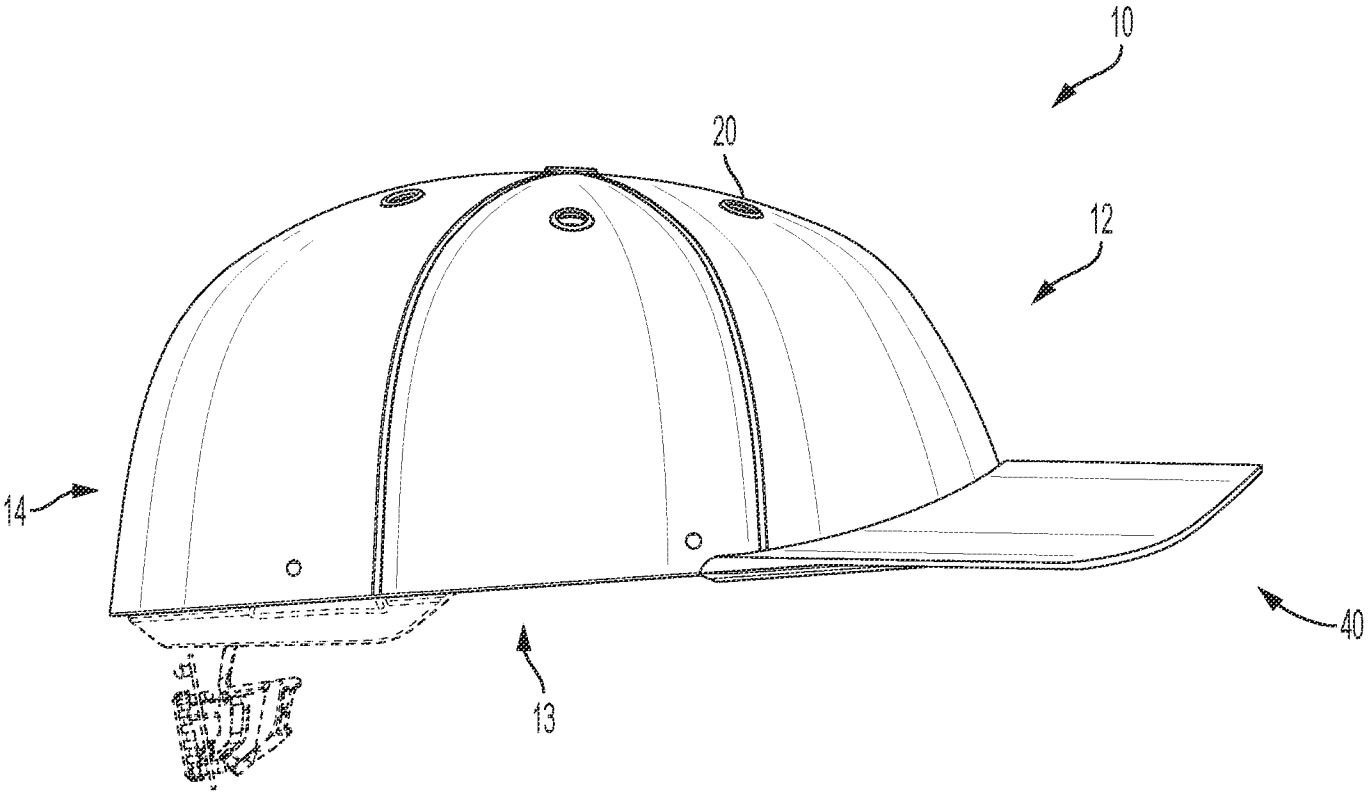
FIG. 34 is a second side elevation view of the helmet and the curved brimmed visor shown in FIG. 31.
Figure 35:
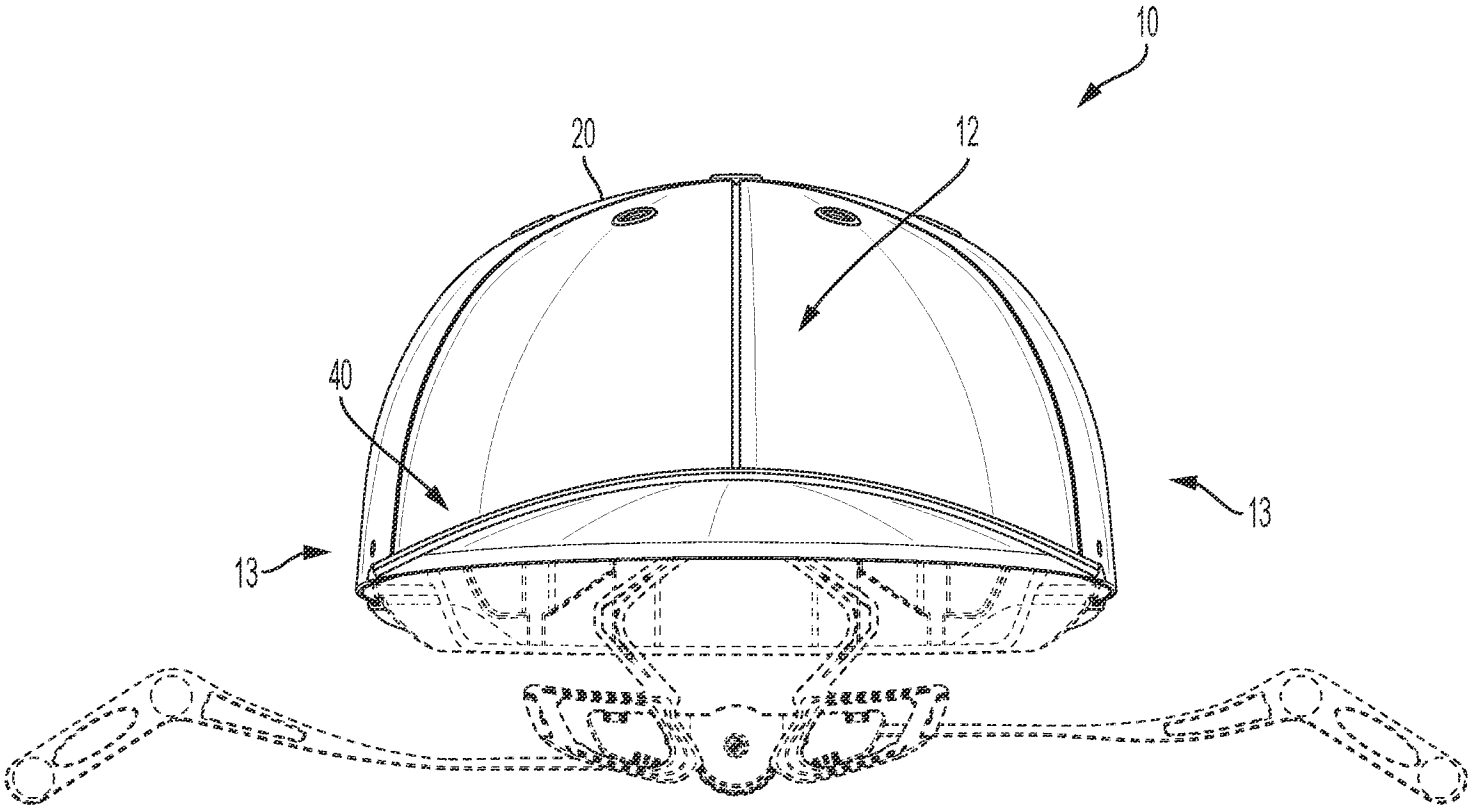
FIG. 35 is a front elevation view of the helmet and the curved brimmed visor shown in FIG. 31.
Figure 36:
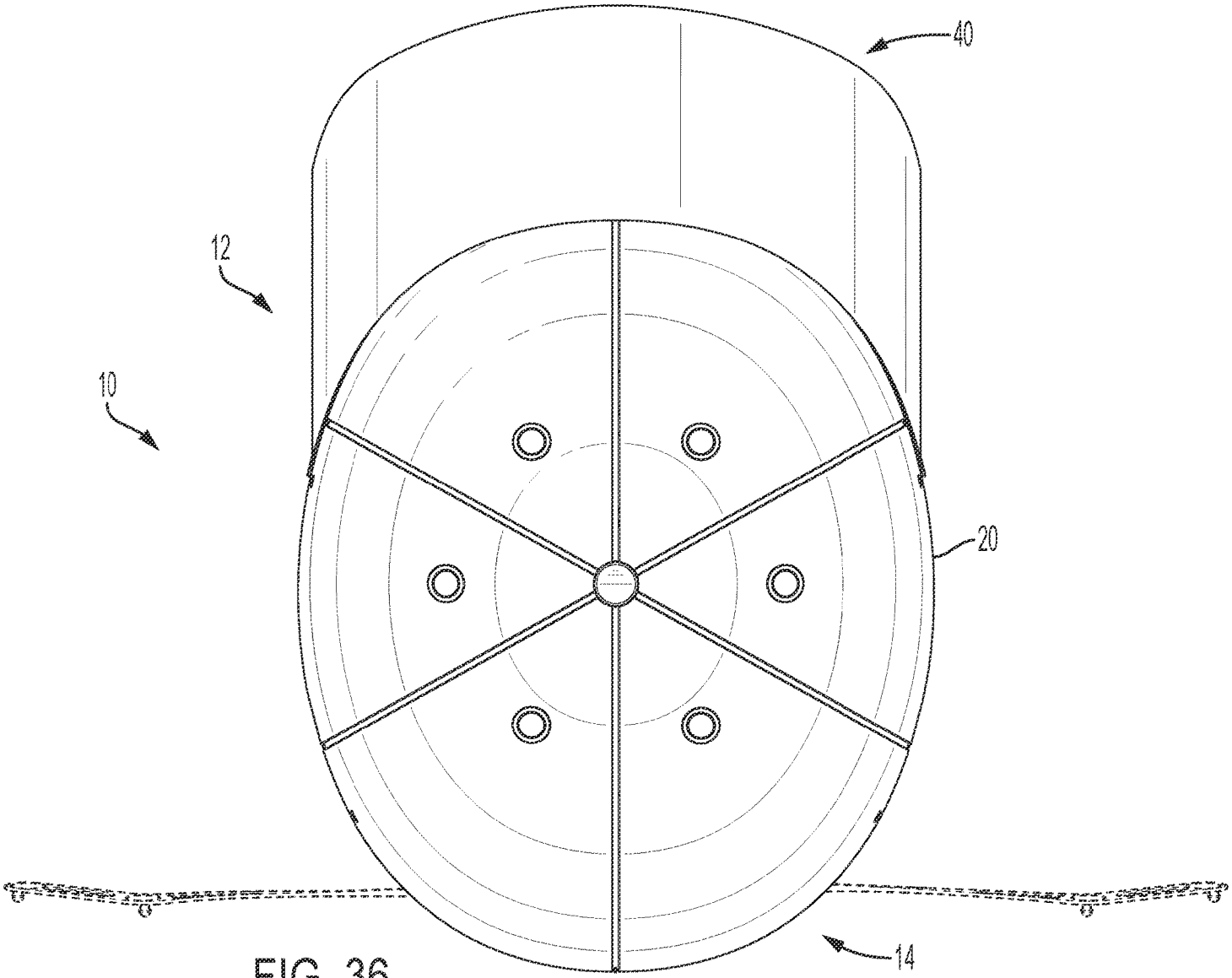
FIG. 36 is a top plan view of the helmet and the curved brimmed visor shown in FIG. 31.
Figure 37:
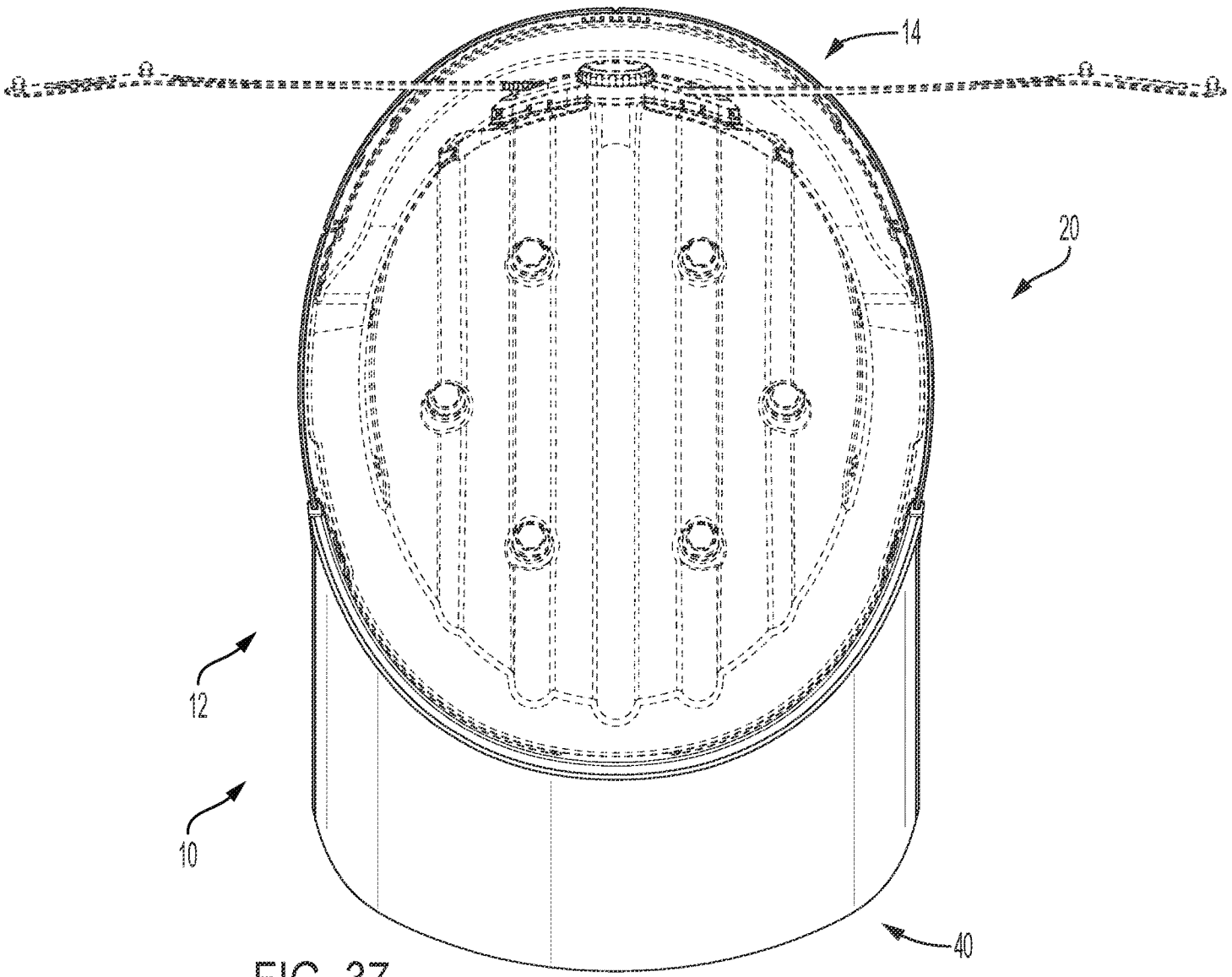
FIG. 37 is a bottom plan view of the helmet and the curved brimmed visor shown in FIG. 31.
Figure 38:
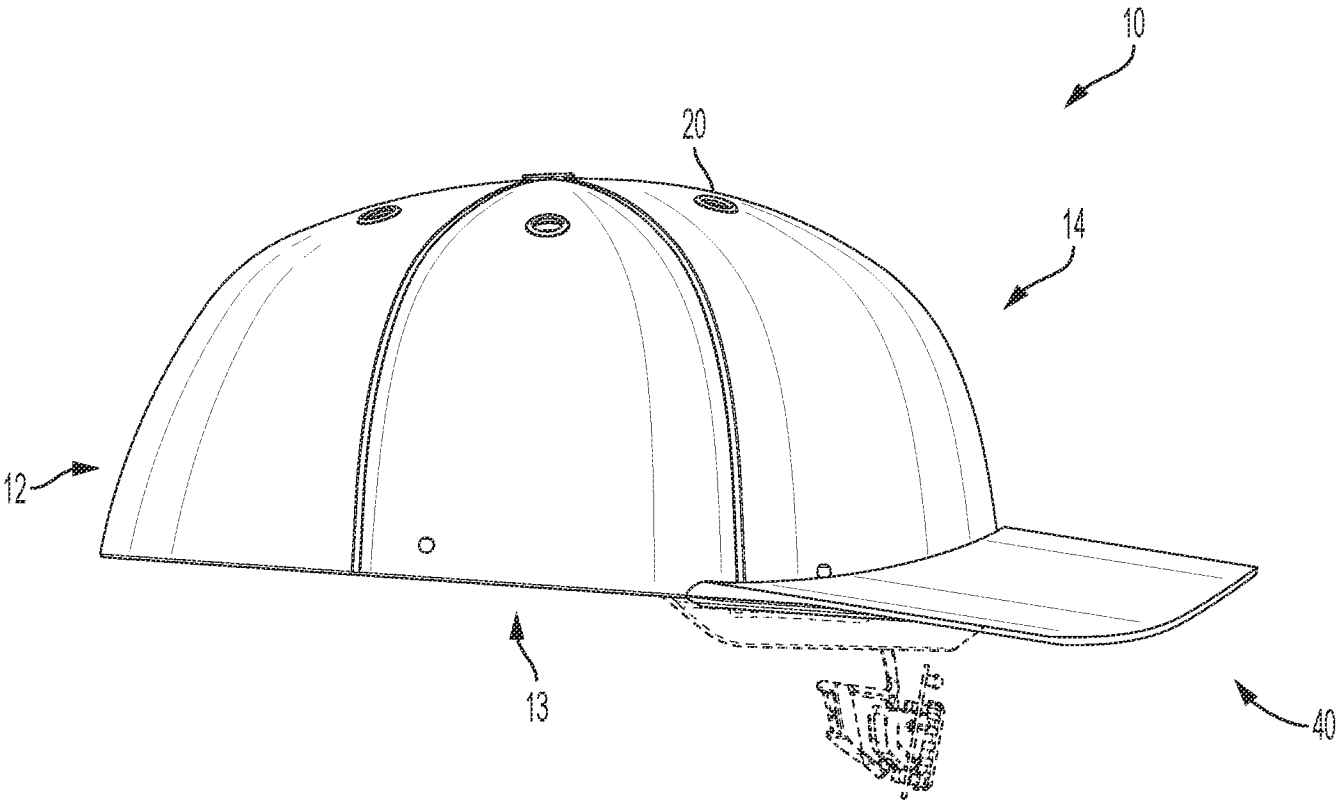
FIG. 38 is a side elevation view of the helmet with the curved brimmed visor shown in FIG. 31 removably coupled thereon in a rearward-facing position in accordance with an illustrative embodiment of the invention disclosed herein.

Referring now to the figures of the drawings, wherein like numerals of reference designate like elements throughout the several views, and in spatial reference to a user of the invention, an improved helmet 10 with a visor 40 that removably couples to an arcuate front portion 12 of the helmet 10 in a forward-facing position or configuration (FIGS. 1, 8-13, 15-21, 23-29, 31-37) or to an arcuate rear portion 14 of the helmet 10 in a backward-facing position or configuration (FIGS. 14, 22, 30, 38). The front portion 12 and the rear portion 14 of the helmet 10 can be separated by elongate side portions 13*a* and 13*b*. The helmet 10 is an open-face helmet, not a full-face helmet, and the helmet can be a bike helmet or a helmet that can be used for other applications and in other industries that also use protective headwear.

The helmet 10 can be made of a single molded shell or of two or more shells of energy absorbing material. As exemplified in the drawings, the helmet 10 includes an outer protective shell 20 coupled to an inner absorbent shell 22. The visor 40 can be removably attached to the outer shell 20, the inner shell 22, or both. The outer shell 20 and the inner shell 22 can respectively have coaxial aligned and axially spaced vent holes 24 and 26.

The outer shell 20 and/or the visor 40 can be constructed from a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, cast urethane, or other similar material. The visor 40 may be of an opaque, translucent, or transparent material.

The outer shell 20 and/or the visor 40 can be stamped, in-molded, injection molded, vacuum formed, or formed by another suitable process. The outer shell 20 can also be permanently or releasably coupled to the inner shell 22, using any suitable chemical or mechanical fastener or attachment device or substance including without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners. The inner shell 22 of the helmet 10 can be formed of expanded polystyrene (EPS), expanded polyurethane (EPU), expanded polyolefin (EPO), expanded polypropylene (EPP), or other suitable material.

Figure 2:
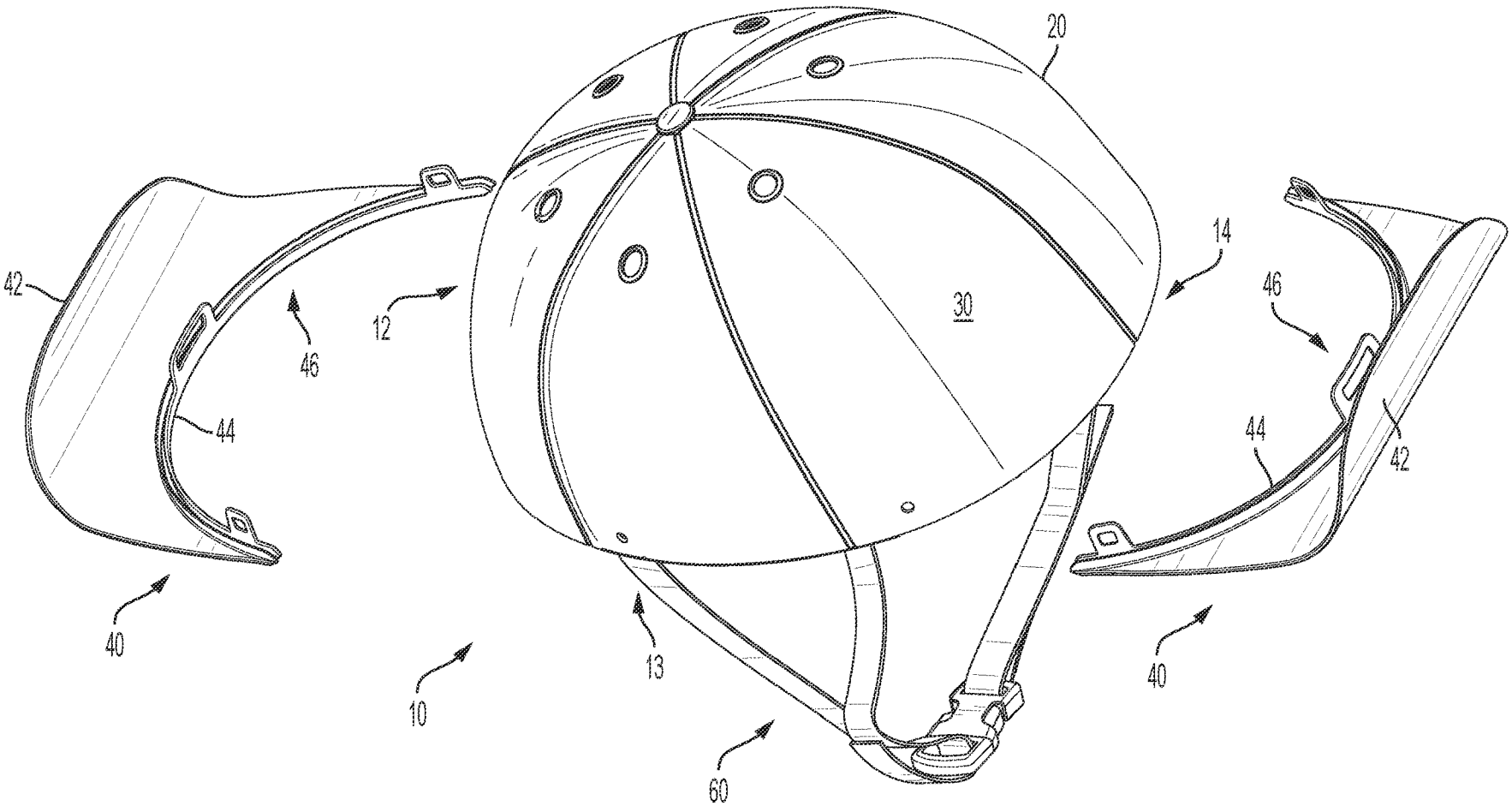
FIG. 2 is a partially exploded, rear perspective view of an example of a helmet with an upwardly extra bent brimmed visor.
Figure 3:
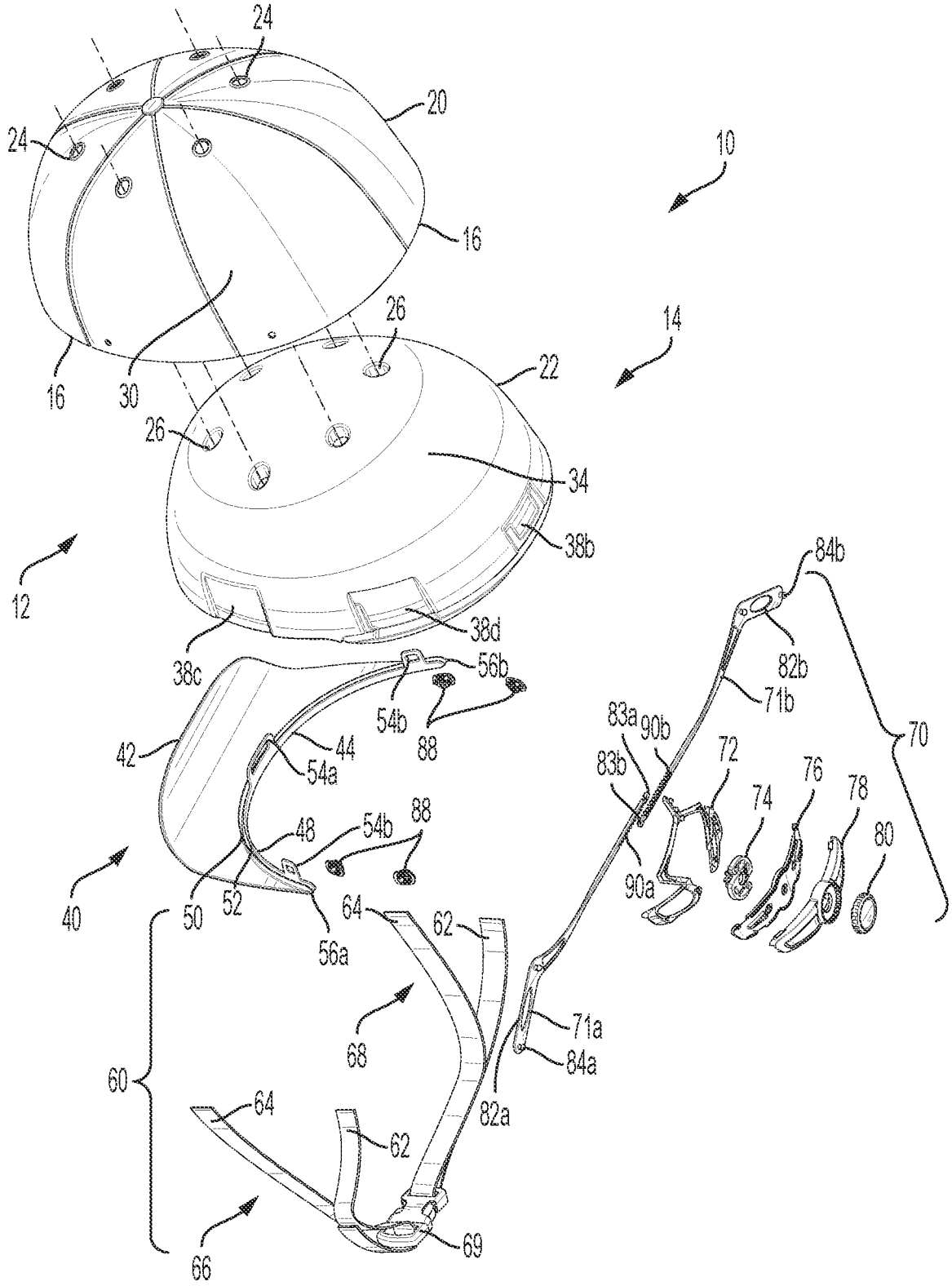
FIG. 3 is a fully exploded, rear perspective view of the helmet shown in FIG. 1.
Figure 4:
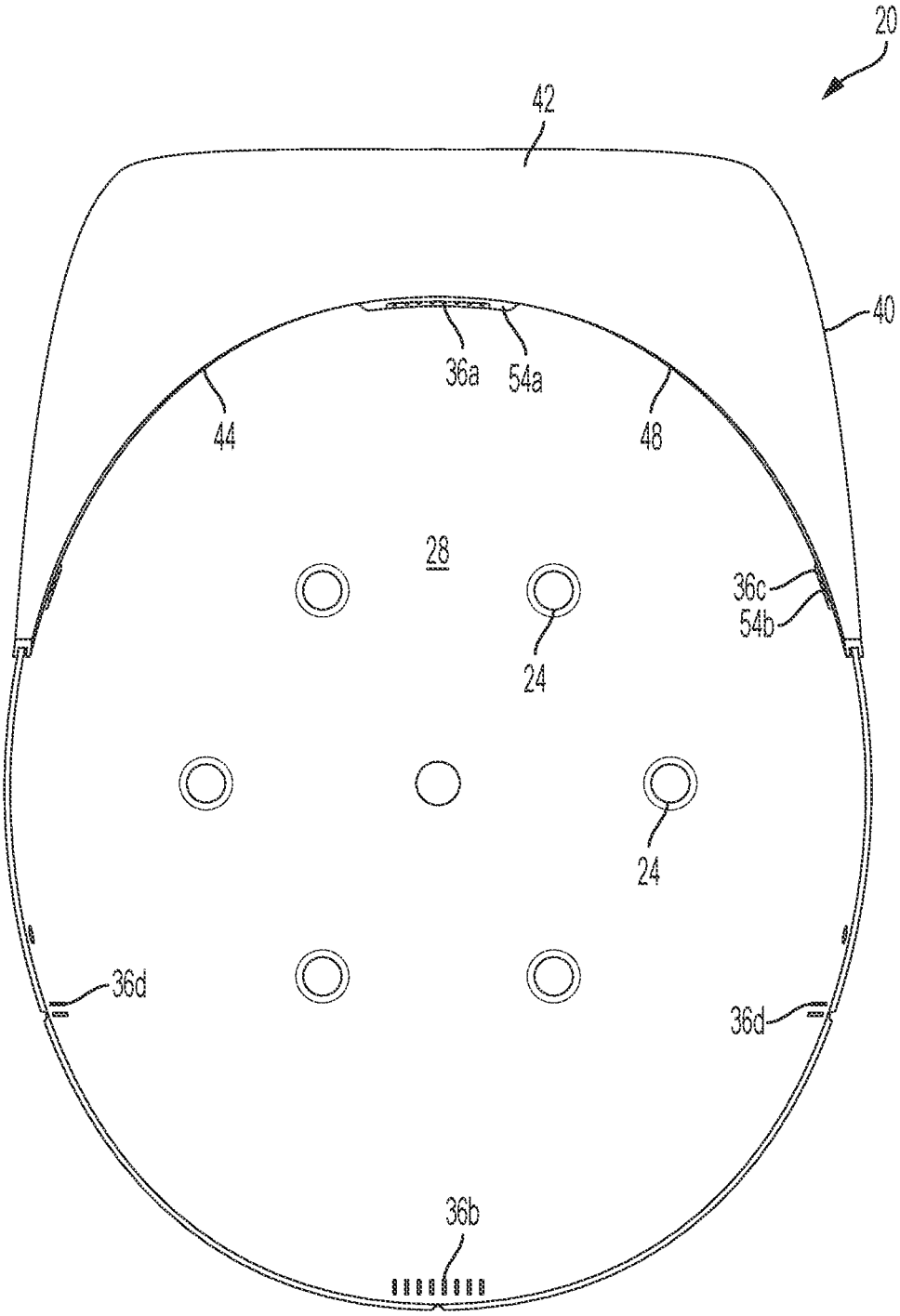
FIG. 4 is a bottom plan view of an outer shell of a helmet and a visor removably coupled thereto in accordance with an illustrative embodiment of the invention disclosed herein.
Figure 5:
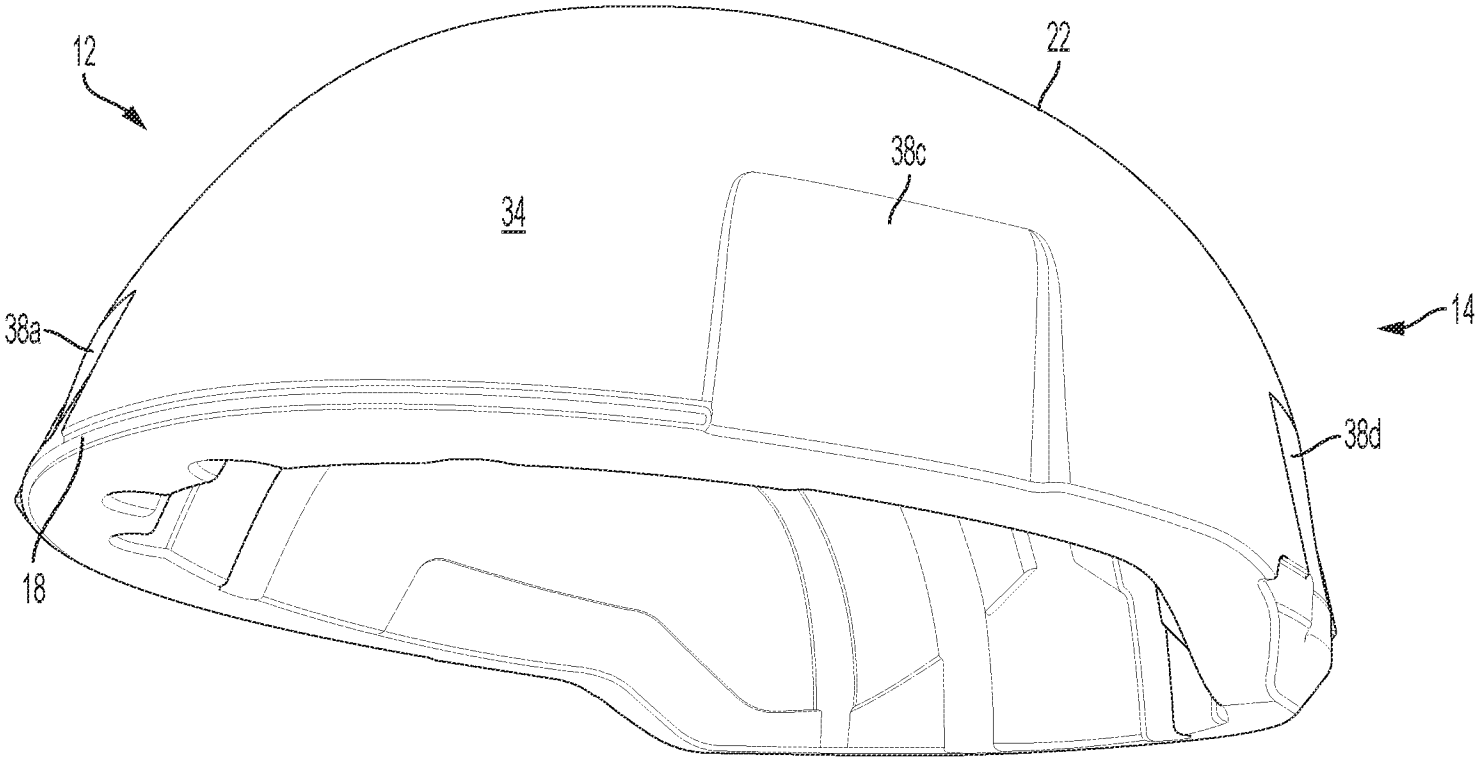
FIG. 5 is a bottom perspective view of an inner shell of a helmet in accordance with an illustrative embodiment of the invention disclosed herein.
Figure 6:
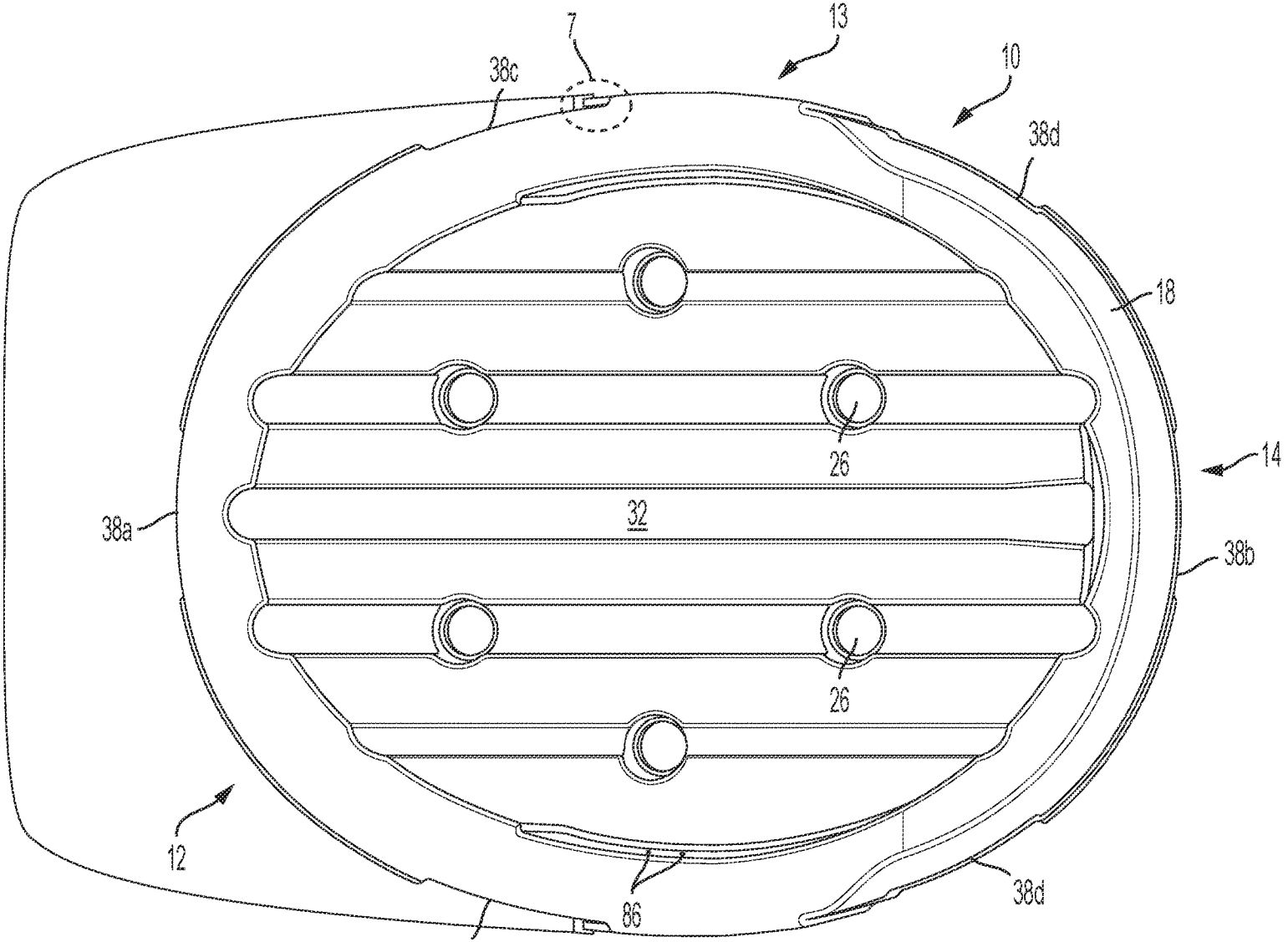
FIG. 6 is a bottom plan view of a helmet and a visor removably coupled thereto a forward-facing position in accordance with an illustrative embodiment of the invention disclosed herein.
Figure 7:
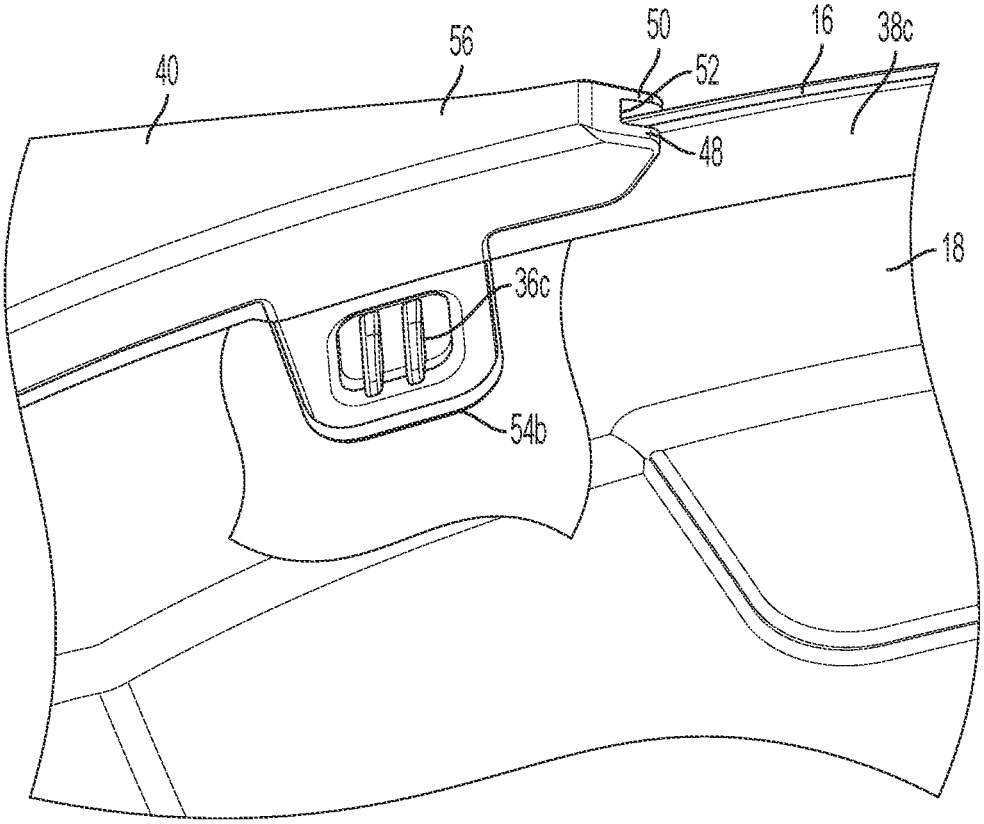
FIG. 7 is a partial cutaway view of area 7 of FIG. 6.
Figure 39:
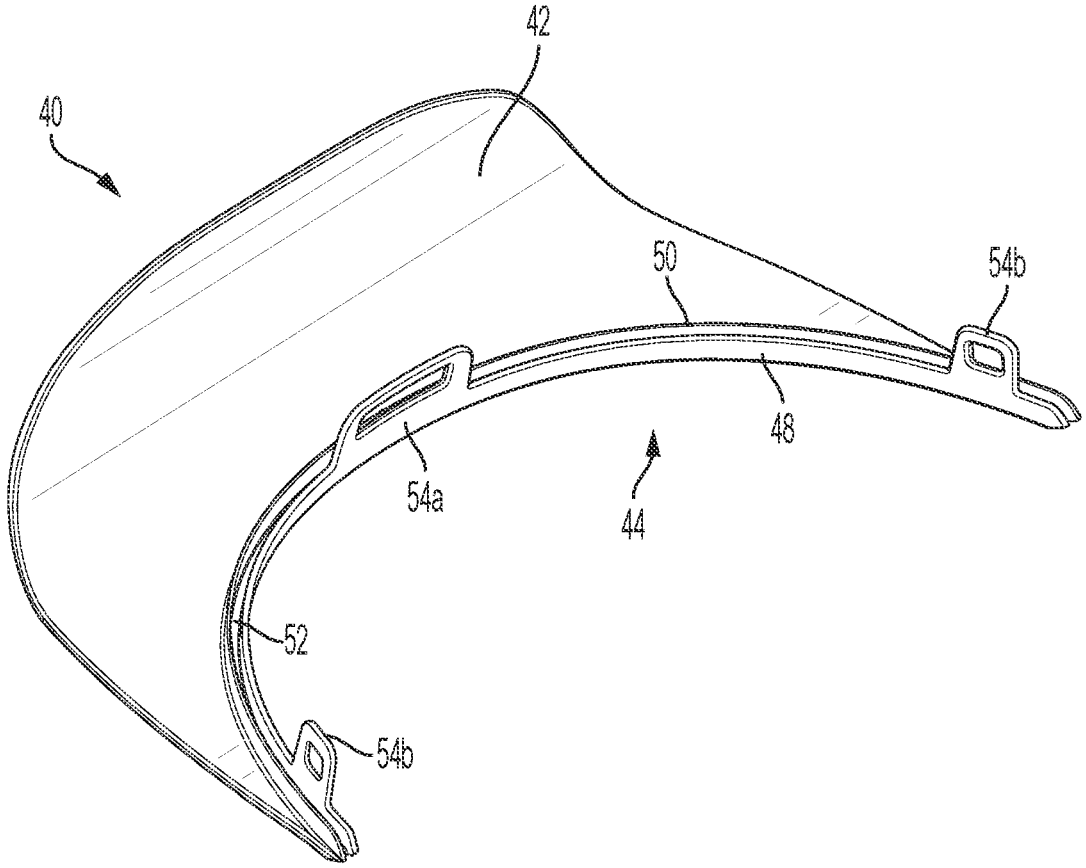
FIG. 39 is a rear perspective view of the extra bent brimmed visor shown in FIGS. 1 and 8-14.
Figure 40:
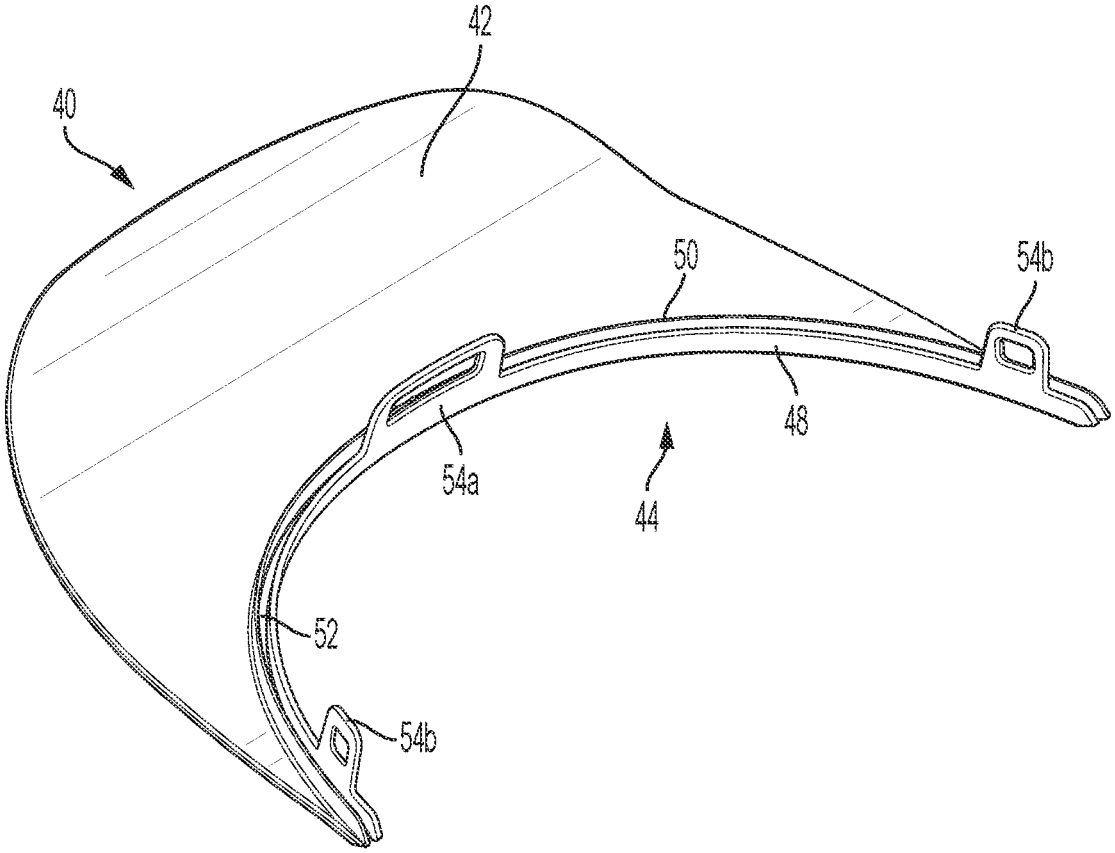
FIG. 40 is a rear perspective view of the bent brimmed visor shown in FIGS. 15-22.
Figure 41:
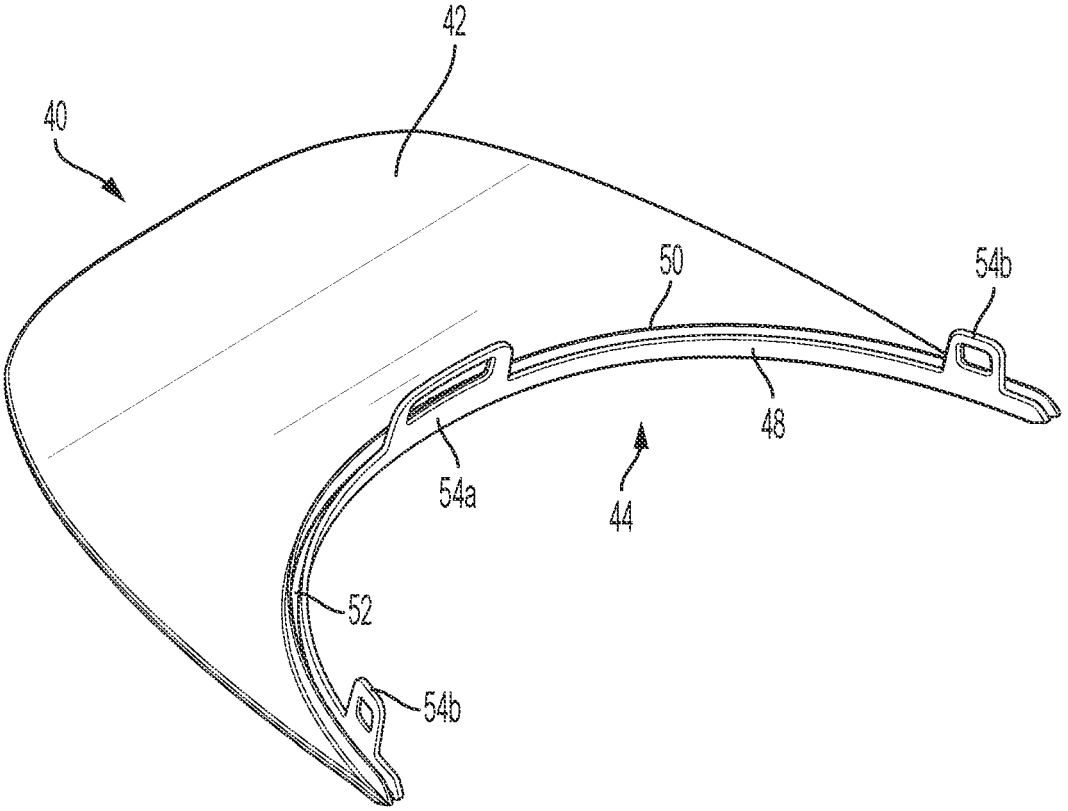
FIG. 41 is a rear perspective view of the flat brimmed visor shown in FIGS. 23-30.
Figure 42:
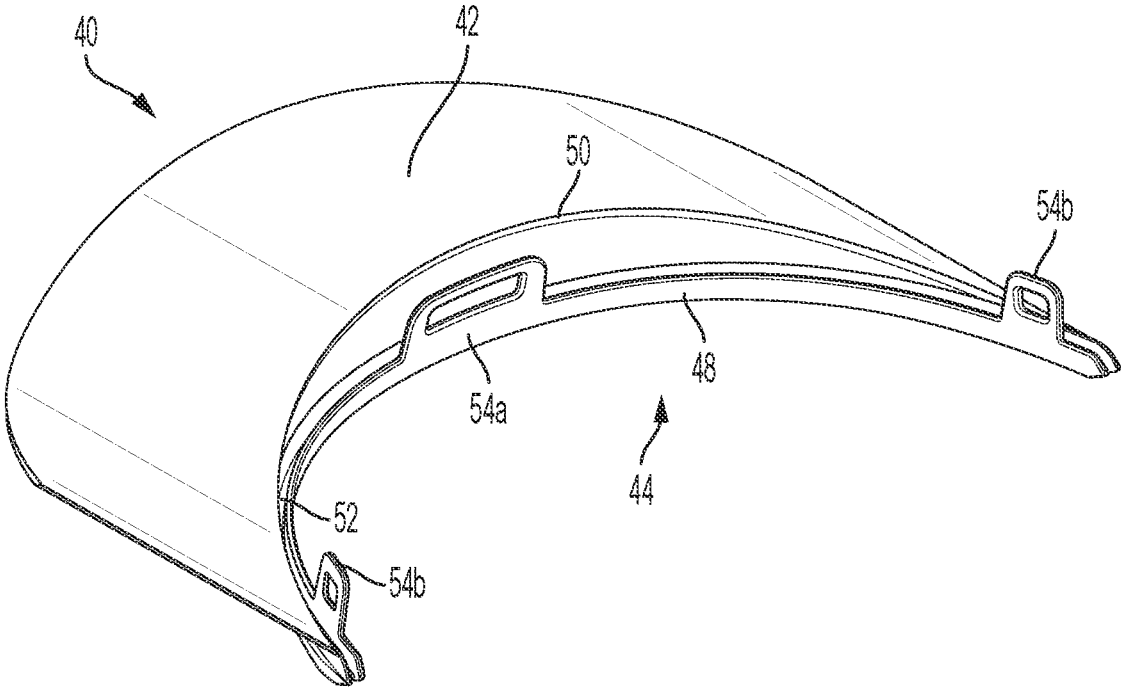
FIG. 42 is a rear perspective view of the curved brimmed visor shown in FIGS. 31-38.

The outer shell 20 has an outer surface 30 that is oriented away from the user and exposed to the environment and an inner surface 28 that is oriented toward an outer surface 34 of the inner shell 22. As illustrated, the outer surface 30 of the outer shell 20 is constructed to resemble a baseball cap with the visor 40 constructed to resemble a curved brim (FIGS. 31-38, 42), a flat brim (FIG. 23-30, 41), a bent brim (FIG. 15-22, 40), or an extra bent brim (FIG. 1-14, 39). The outer surface 30 may be symmetric where the forward-facing portion 12 and the rearward-facing portion 14 are the same height. Alternatively, the outer surface 30 of the outer shell 20 may be asymmetric such that the forward-facing portion 12 is taller than of the rearward-facing portion 14 of the outer shell 20 of the helmet 10, or vice versa such that the rearward-facing portion 14 is taller than of the forward-facing portion 12 of the helmet 10. In addition, the outer surface 30 of the other shell 20 can have a plurality of panels 21 separated by a seam or groove 23 in the outer shell 20. As exemplified in the figures, the outer surface 30 of the outer shell 20 is configured with six (6) panels 21; however, the two (2) panels 21*a* and 21*b* in the front portion 12 can be combined into a single panel for a five (5) panel baseball cap-style helmet 10.

The inner shell 22 has the outer surface 34 that is oriented away from the user and an inner surface 32 opposite the outer surface 34, which is oriented towards the user's head. An in-molded helmet 10 can be formed with an inner surface 28 of the outer shell 20 of the helmet 10 being bonded directly to an outer surface 34 of the inner shell 22, and by expanding foam or the inner shell 22 into the outer shell 20. As such, the inner shell 22 can, in some embodiments, be in-molded into outer shell 20, as single monolithic body of energy absorbing material. Alternatively, in other embodiments the inner shell 22 can be formed of multiple, or a plurality, of portions or layers.

The inner surface 28 of the outer shell 20 includes a plurality of visor attachment protrusions 36, and the outer surface 34 of the inner shell 22 has a plurality of visor attachment recesses 38 corresponding to the visor attachment protrusions 36. For purposes of exemplification rather than limitation, the inner surface 28 of the outer shell 20 is illustrated in the figures has having a front protrusion 36*a*, a rear protrusion 36*b*, a pair of front portion side protrusions 36*c*, and a pair of rear portion side protrusions 36*d*. Similarly, the outer surface 34 of the inner shell 22 is illustrated as having a front visor attachment recess 38*a*, a rear visor attachment recess 38*b*, a pair of front portion side recesses 38*c*, and a pair of rear portion side recesses 38*d*.

The visor 40 includes a brim portion 42 that is oriented away from the outer shell 20 of the helmet 10 and that can be configured as the curved brimmed visor 40 (FIGS. 31-38, 42), the flat brimmed visor 40 (FIGS. 23-30, 41), the upwardly bent brimmed visor 40 (FIGS. 15-22, 40), or the extra bent brimmed visor 40 (FIGS. 1-14, 39). The visor 40 also includes an arcuate portion that is oriented toward the outer shell 20 of the helmet 10 and is configured to wrap about the front portion 12 or the rear portion 14 of the outer shell 20 of the helmet 10. The arcuate portion of the visor 40 includes a visor coupling mechanism 44 that allows the user to attach and detach the visor 40 from the forward-facing position on the front portion 12 of the helmet 10 to the backward-facing position on the rear portion 14 of the helmet 10, or vice versa quickly and easily. The visor coupling mechanism 44 mechanically attaches the visor 40 to the front portion 12 or the rear portion 14 of the helmet 10, and can include clips, flaps, clamps, pins, appendages, plugs, threaded inserts into the helmet to receive a screw or bolt, the use of hook and loop type fastening materials, or the provision of a hole in the helmet into which a member is frictionally inserted. For purposes of exemplification rather than limitation, the visor coupling mechanism 44 is illustrated as having an internal upright ridge or edge 48 and an external upright ridge or edge 50 with an intermediate arcuate channel 52 therebetween. The internal upright ridge or edge 48 of the visor coupling mechanism 44 includes a plurality of upright attachment apertures 54, and more particularly includes an upright aperture 54 *a* positioned at approximately a midline of the arcuate channel 52 of the visor coupling mechanism 44 and a plurality of side upright apertures 54 *b* Reply to Office Action dated Sep. 1, 2023 positioned near opposing ends 56 *a*/56 *b* of the arcuate channel 52 of the visor coupling mechanism 44. As illustrated, the arcuate channel 52 has a width W and an arc angle AA that corresponds to a thickness T and an arc angle AA' of a terminal edge 16 of the front portion 12 or the rear portion of the outer shell 20. Alternatively, the width W and the arc angle AA of the arcuate channel corresponds to a thickness T" and an arc angle AA" of a terminal edge 18 of the front portion or the rear portion 14 of the inner shell 22 of the helmet 10, or yet further the combined thickness of both T' and T".

The visor 40 can be selectively coupled to the outer shell 20, the inner shell 22, or both in the forward-facing or the rearward-facing position using the visor coupling mechanism 44. As illustrated in the figures, to attach the visor 40 to the outer shell 20 of the helmet 10 in the forward-facing position, the terminal edge 16 of the front portion 12 of the outer shell 20 is received and seated within the arcuate channel 52. The internal upright ridge or edge 48 of the visor coupling mechanism 44 adjoins and is in contact with the inner surface 28 of the front portion 12 of the outer shell 20 while the external upright ridge or edge 50 adjoins and is in contact with the outer surface 34 of the front portion 12 of the outer shell 22 of the helmet 10. The front protrusion 36 *a* on the front portion 12 of the inner surface 28 of the outer shell 20 is received within and releasably coupled to the midline upright aperture 54 *a* on the internal upright ridge or edge 48 of the visor coupling mechanism 44. Similarly, the front portion side protrusions 36 *c* on the inner surface 28 of the outer shell 20 are received within and releasably coupled to the side upright apertures 54 *b* of the visor coupling mechanism 44. If the inner shell 22 is a separate component from the outer shell 20, the inner shell 22 can then be reinserted into the outer shell 20 such that the front protrusion 36 *a* and the midline upright aperture 54 *a* are positioned within the front visor attachment recess 38 *a*, and the front portion side protrusions 36 *c* and the side upright apertures b are positioned within the front portion, side visor attachment recesses 38 *c*.

To reverse the visor 40 to the rearwardly-facing position, the user simply removes the inner shell 22 from the outer shell 20, disconnects the visor coupling mechanism 44 from the front portion 12 of the outer shell 20, reverses the visor 10 from the forward-facing position to the rearward-facing position, and then reconnects the visor coupling mechanism 44 to the rear portion of the outer shell 20 of the helmet 10 in a manner noted above. In particular, the terminal edge of the rear portion 14 of the outer shell 20 is received and seated within the arcuate channel 52. The internal upright ridge or edge 48 of the visor coupling mechanism 44 adjoins and is in contact with the inner surface 28 of the rear portion 14 of the outer shell 20 while the external upright ridge or edge 50 adjoins and is in contact with the outer surface 34 of the rear portion 14 of the outer shell 22 of the helmet 10. The rear protrusion 36 *b* on the rear portion 14 of the inner surface 28 of the outer shell 20 is received within and releasably coupled to the midline upright aperture 54 *a* on the internal upright ridge or edge 48 of the visor coupling mechanism 44. Similarly, the rear portion side protrusions 36 *d* on the inner surface 28 of the outer shell 20 are received within and releasably coupled to the side upright apertures 54 *b* of the visor coupling mechanism 44. If the inner shell 22 is a separate component from the outer shell 20, the inner shell 22 can then be reinserted into the outer shell 20 such that the rear protrusion 36 *b* and the midline upright aperture a are positioned within the rear visor attachment recess 38 *b*, and the rear portion side protrusions 36 *d* and the side upright apertures 54 *b* are positioned within the rear portion side visor attachment recesses 38 *d*.

Straps or webbing 60 are used to allow a user to releasably wear the helmet 10, and to ensure the helmet 10 remains on the user's head during usage and in the event of an impact. The straps 60 can include a rear portion or strap 62, a front portion or strap 64, a left portion or strap 66, and a right portion or strap 68. While the various portions 62, 64, 66, and 68 of the straps 60 can be portions of one or more single continuous straps, the portions 62, 64, 66, and 68 of the straps 60 can also be separate, distinct, or discrete segments of strap. In either event, the portions 62, 64, 66, and 68 of the straps 60 can be coupled or joined together mechanically or chemically, including by sewing, by being threaded through strap adjustors or clips, or by any other suitable method. As exemplified, a clip, fastener, or attachment device 69 releasably attaches portions of the straps 60 together and can be coupled at a position that will be below the chin or at a neck of the user when the helmet is worn. The clip 69 can comprise a left portion 69*a* and a right portion 69*b* that can be coupled by friction, magnetism, or both, as well as by any other desirable way.

In addition, the helmet 10 can include a fit adjustment assembly 70 to allow the user to easily adjust a fit of the helmet 10. The fit adjustment assembly 70 can be coupled to the rear portion of 16 of the inner shell 22 or could also be coupled directly to the outer shell 20 of the helmet 10. The fit adjustment assembly 70 can be at least partially disposed within an area or space defined by the inner shell 22 to receive the head of the user. As illustrated in the figures, the fit adjustment assembly 70 can be formed of plastic, metal, resin, fiber, or other suitable material, and it can include a pair of adjustment arms 71*a* and 71*b*, a padded cradle 72, a pinion 74, a rear mounting plate 76, a dial mounting plate 78, and an adjustable dial 80.

The padded cradle 72 is coupled to the pinion 74, which in turn is coupled to the rear mounting plate 76, which is in turn is coupled to the dial mounting plate 78, and the dial 80 is rotatably coupled to the mounting plate 78. The adjustment arms 71*a* and 71*b* pass through openings within the dial mounting plate 78, and the pinion 74 is coupled to the adjustment arm 71*a*, the adjustment arm 71*b*, or both adjustment arms 71*a* and 71*b*. The adjustment arms 71*a* and 71*b* can be removably coupled to the inner surface 32 of the inner shell 22 or the inner surface 28 of the outer shell 20. For purposes of illustration rather than limitation, terminal ends 82*a* and 82*b* of the adjustment arms 71*a* and 71*b* include one or more attachment protrusions 84*a* and 84*b*, which are respectively received within attachment recesses 86*a* and 86*b* in the inner surface 32 of the inner shell 22. Attachment covers 88*a* and 88*b* can be further used to cover and attach the attachment protrusions 84*a* and 84*b* of the adjustment arms 71*a* and 71*b* within the attachment recesses 86*a* and 86*b* in the inner surface 32 of the inner shell 22. Terminal ends 83*a* and 83*b* of the attachment arms 71*a* and 71*b* include teeth or ridges 90*a* and 90*b* that are aligned with and engage with the pinion 74, which in turn in rotatably engaged with the adjustment dial 80. Alternatively, terminal ends 83*a* and 83*b* of the attachment arms 71*a* and 71*b* could be formed without teeth, and other suitable attachment mechanisms could be used, such as elastic cords, bungees, or slide locks that tighten or loosen to adjust a size of the fit adjustment assembly.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that such components may be comprised of any shape, size, style, type, model, version, class, grade, measurement, concentration, material, weight, quantity, and/or the like consistent with the intended purpose, method and/or system of implementation and a number of modifications may be made without departing from the spirit thereof and that these embodiments and implementations may be applied to other to helmet customization technologies as well. Accordingly, the disclosed subject matter is intended to embrace all such alterations, modifications, and variations that fall within the spirit and scope of the disclosure and the knowledge of one of ordinary skill in the art, together with all changes that come within the meaning of, and range of equivalency of, the claims. The presently disclosed embodiments are, therefore, to be considered in all respects as illustrative and not restrictive.

What is claimed is:

1. A helmet, comprising:

an outer protective shell having a forward-facing portion, a rearward-facing portion, and an inner surface comprising a plurality of visor attachment protrusions;

an inner absorbent shell having a forward-facing portion, a rearward-facing portion, and an exterior surface comprising a plurality of visor attachment recesses; and a visor removably attachable to both the forward-facing portion and the rearward-facing portion of (i) the outer protective shell, (ii) the inner absorbent shell, or (iii) a combination of both the outer protective shell and the inner absorbent shell, wherein the visor comprises a visor coupling mechanism configured to mechanically attach the visor to both the forward-facing portion and the rearward-facing portion of (i) the outer protective shell, (ii) the inner absorbent shell, or (iii) the combination of both the outer protective shell and the inner absorbent shell, the visor coupling mechanism comprising:

an arcuate internal upright ridge, wherein the internal upright ridge comprises a plurality of upright attachment apertures, the visor attachment protrusions on the inner surface of the outer protective shell being removably attachable to the upright attachment apertures, the visor attachment recesses configured to receive the upright attachment apertures when attached to the visor attachment protrusions.

2. The helmet of claim 1 wherein the outer protective shell is configured as having an appearance of a baseball cap and as having a plurality of panels, a plurality of vent holes, or both the plurality of panels and the plurality of vent holes.

3. The helmet of claim 2 wherein the outer protective shell has the plurality of vent holes, wherein the inner absorbent shell has a second plurality of vent holes coaxially spaced from and axially aligned with the plurality of vent holes in the outer protective shell.

4. The helmet of claim 3 wherein the visor is configured as a flat brim visor, a bent brim visor, or an extra bent brim visor.

5. The helmet of claim 2 wherein the plurality of panels comprises five panels or six panels, which are separated from one another by a seam or groove.

6. The helmet of claim 1 wherein the internal upright ridge is configured to wrap about the inner surface of the outer protective shell, the visor coupling mechanism further comprising:

an arcuate external upright ridge configured to wrap about an outer surface of the outer protective shell; and an intermediate arcuate channel between the internal upright ridge and the external upright ridge.

7. The helmet of claim 6 wherein terminal ends of the forward-facing portion and the rearward-facing portion of the outer protective shell are each configured to seat within the intermediate arcuate channel of the visor coupling mechanism.

8. The helmet of claim 6 wherein terminal ends of the forward-facing portion and the rearward-facing portion of the outer protective shell are both configured to seat within the intermediate arcuate channel of the visor coupling mechanism.

9. The helmet of claim 1 further comprising a chin or neck strap, a fit adjustment assembly, or both the chin or neck strap and the fit adjustment assembly.

10. A protective helmet, comprising:

an outer protective shell having a forward-facing portion and a rearward-facing portion;

an inner absorbent shell having a forward-facing portion and a rearward-facing portion; and a visor removably attachable to both the forward-facing portion and the rearward-facing portion of (i) the outer protective shell, ii the inner absorbent shell, or iii) a combination of both the outer protective shell and the inner absorbent shell, wherein the visor comprises a visor coupling mechanism configured to mechanically attach the visor to both the forward-facing portion and the rearward-facing portion of (i) the outer protective shell, (ii) the inner absorbent shell, or (iii) the combination of both the outer protective shell and the inner absorbent shell; the visor coupling mechanism comprising:

an arcuate internal upright ridge configured to wrap about an inner surface of the outer protective shell, wherein the internal upright ridge comprises a plurality of upright attachment apertures;

an arcuate external upright ridge configured to wrap about an outer surface of the outer protective shell; and an intermediate arcuate channel between the internal upright ridge and the external upright ridge; terminal ends of the forward-facing portion and the rearward-facing portion of the outer protective shell each configured to seat within the intermediate arcuate channel of the visor coupling mechanism, wherein the outer protective shell comprises a plurality of visor attachment protrusions on an inner surface of the outer protective shell, the visor attachment protrusions being removably attachable to the upright attachment apertures of the internal upright ridge of the visor coupling mechanism, wherein the inner absorbent shell comprises a plurality of visor attachment recesses on an exterior surface of the inner absorbent shell, the visor attachment recesses configured to receive the upright attachment apertures of the internal upright ridge of the visor coupling mechanism when attached to the visor attachment protrusions on the inner surface of the outer protective shell.

11. The helmet of claim 10 wherein the outer protective shell is configured as having an appearance of a baseball cap and as having a plurality of panels, a plurality of vent holes, or both the plurality of panels and the plurality of vent holes.

12. The helmet of claim 11 wherein the outer protective shell has the plurality of vent holes, wherein the inner absorbent shell has a second plurality of vent holes coaxially spaced from and axially aligned with the plurality of vent holes in the outer protective shell.

13. The helmet of claim 12 wherein the visor is configured as a flat brim visor, a bent brim visor, or an extra bent brim visor.

14. The helmet of claim 11 wherein the plurality of panels comprises five panels or six panels, which are separated from one another by a seam or groove.

15. The helmet of claim 10 further comprising a chin or neck strap, a fit adjustment assembly, or both the chin or neck strap and the fit adjustment assembly.

* * * * *